US008430477B2

(12) United States Patent
Sakata et al.

(10) Patent No.: US 8,430,477 B2
(45) Date of Patent: Apr. 30, 2013

(54) LIQUID INJECTION HEAD, LIQUID INJECTION RECORDING APPARATUS, AND METHOD OF FILLING LIQUID INJECTION HEAD WITH LIQUID

(75) Inventors: Akifumi Sakata, Chiba (JP); Kazuyoshi Tominaga, Chiba (JP); Toshiaki Watanabe, Chiba (JP); Masatoshi Toda, Chiba (JP); Akihiro Sadaki, Chiba (JP)

(73) Assignee: SII Printek Inc. (JP)

( * ) Notice: Subject to any disclaimer, the term of this patent is extended or adjusted under 35 U.S.C. 154(b) by 175 days.

(21) Appl. No.: 12/736,994

(22) PCT Filed: May 15, 2009

(86) PCT No.: PCT/JP2009/059205

§ 371 (c)(1),
(2), (4) Date: Apr. 25, 2011

(87) PCT Pub. No.: WO2009/147944

PCT Pub. Date: Dec. 10, 2009

(65) Prior Publication Data

US 2011/0199432 A1 Aug. 18, 2011

(30) Foreign Application Priority Data

Jun. 5, 2008 (JP) ..... 2008-148384
Apr. 3, 2009 (JP) ..... 2009-091256

(51) Int. Cl.
*B41J 2/165* (2006.01)

(52) U.S. Cl.
USPC ..... 347/29; 347/30; 347/34

(58) Field of Classification Search ..... 347/22, 347/30, 34, 36, 44, 47, 64–67, 77, 89–90
See application file for complete search history.

(56) References Cited

U.S. PATENT DOCUMENTS 3,776,461 A * 12/1973 Kashio ..... 239/125
5,534,898 A * 7/1996 Kashino et al. ..... 347/33
7,735,966 B2 * 6/2010 Silverbrook ..... 347/47
7,878,620 B2 * 2/2011 Hasegawa ..... 347/29

FOREIGN PATENT DOCUMENTS

WO 9635584 11/1996

OTHER PUBLICATIONS

Patent Abstracts of Japan, publication No. 05-084930, publication date Apr. 6, 1993.
Patent Abstracts of Japan, publication No. 02-032857, publication date Feb. 2, 1990.

(Continued)

*Primary Examiner* — Thinh Nguyen
(74) *Attorney, Agent, or Firm* — Adams & Wilks

(57) ABSTRACT

A liquid injection head has a nozzle body having a row of nozzle holes and a nozzle guard that covers the row of nozzle holes. The nozzle guard has a top portion having formed therein a slit opposed to the row of nozzle holes, a sealing portion that seals an area between a peripheral edge of the top portion and the nozzle body, and a suction flow path having a suction port opening below the row of nozzle holes and communicating with a space on an inner side of the nozzle guard. A suction section connected to the suction flow path of the nozzle guard causes the space on the inner side of the nozzle guard to form a negative pressure chamber such that a liquid overflowing into the negative pressure chamber is sucked from the suction port of the suction flow path.

22 Claims, 12 Drawing Sheets

OTHER PUBLICATIONS

Patent Abstracts of Japan, publication No. 2006-043963, publication date Feb. 16, 2006.
Patent Abstracts of Japan, publication No. 2002-052742, publication date Feb. 19, 2002.
Patent Abstracts of Japan, publication No. 2006-168077, publication date Jun. 29, 2006.
Patent Abstracts of Japan, publication No. 11-334106, publication date Dec. 7, 1999.
Patent Abstracts of Japan, publication No. 2003-320673, publication date Nov. 11, 2003.
Patent Abstracts of Japan, publication No. 2006-082344, publication date Mar. 30, 2006.
Patent Abstracts of Japan, publication No. 2001-334684, publication date Dec. 4, 2001.
Patent Abstracts of Japan, publication No. 2007-216442, publication date Aug. 30, 2007.
Patent Abstracts of Japan, publication No. 2006-231772, publication date Sep. 7, 2006.

* cited by examiner 10
11
11b
23
31
32
24
24a
24b
24c
24e
(24g)
24f
(24h)
24j
15
15a
26
31a
I
R(S)
Y

LIQUID INJECTION HEAD, LIQUID INJECTION RECORDING APPARATUS, AND METHOD OF FILLING LIQUID INJECTION HEAD WITH LIQUID

CROSS-REFERENCE TO RELATED APPLICATIONS

This application is a U.S. national stage application of International Application No. PCT/JP2009/059205 filed May 19, 2009, claiming an earliest priority date of Jun. 5, 2008, and published in a non-English language.

BACKGROUND OF THE INVENTION

1. Field of the Invention

The present invention relates to a liquid injection head for injecting liquid from a nozzle injection port to record images and characters on a recording medium, a liquid injection recording apparatus, and a method of filling a liquid injection head with liquid.

2. Description of the Related Art

In general, a liquid injection recording apparatus, for example, an inkjet printer that performs various kinds of printings includes a conveying device that conveys a recording medium and an inkjet head. As one used in the inkjet printer, there is known an inkjet head which includes a nozzle body having a nozzle string including a plurality of nozzle holes, a plurality of pressure generating chambers that are paired with the respective nozzle holes and communicated to the nozzle holes, an ink supply system that supplies ink to the pressure generating chambers, and a piezoelectric actuator placed adjacent to the pressure generating chambers. In the inkjet head, the piezoelectric actuator is driven to pressurize the pressure generating chambers, thereby injecting ink in each of the pressure generating chambers from a nozzle injection port of each of the nozzle holes.

As one type, there is known an inkjet printer which includes a carriage for moving the inkjet head in a direction orthogonal to a conveying direction of a recording sheet (recording medium) and prints the recording sheet. In this type of inkjet printer, a service station for maintenance is provided in a movable range of the inkjet head, and the inkjet head is moved to the service station, whereby the nozzle holes are cleaned and the nozzle holes are initially filled with ink under suction with a cap being placed on the inkjet head.

Further, as a type different from the above-mentioned inkjet printer, there is an inkjet printer which is used for a relatively large recording medium such as a box or the like and prints a recording medium conveyed with an inkjet head being fixed. In this type of inkjet printer, an inkjet head can not be moved, and there is merely a small space for providing a service station between the inkjet head and the recording medium and below the inkjet head. Therefore, when a pressure generating chamber is initially filled with ink, ink is generally supplied from an ink supply system side under pressure.

During filling under pressure, in order to prevent the inkjet head and a vicinity of an inkjet printer from being contaminated with excess ink flowing from the nozzle holes and to prevent the injection of ink after the filling with the ink from being unstable, means for removing excess ink should be considered. Further, this also applies to the case of collecting ink flowing onto a nozzle body during an ordinary use, as well as the case of the initial filling.

JP 05-116338 A discloses an inkjet head in which an ink guide member protruding outward from a nozzle formation surface made of a plate porous absorbent and a block-type ink absorbent connected to the ink guide member are provided below the inkjet head, and the ink guide member receives excess ink and guides it to the ink absorbent so that the ink absorbent absorbs the guided excess ink.

However, according to the related art, the ink guide member and the ink absorbent are provided below the inkjet head. Therefore, there is a problem that the lower part of the inkjet head can not be used effectively. There is another problem that, in the case where an inkjet printer is designed under a predetermined constraint, a lower part of a recording medium can not be printed.

Further, according to the related art, an ink absorbent is allowed to merely absorb excess ink, and hence there is a limit to the amount of excess ink that can be collected.

SUMMARY OF THE INVENTION

The present invention has been made in view of such circumstances, and objects thereof are as follows.

(1) The space factor of a liquid injection head is enhanced to improve the degree of design freedom of a liquid injection recording apparatus.

(2) The ability of collecting excess liquid is enhanced, whereby the contamination with excess liquid is prevented and the liquid injection after the filling of liquid is stabilized.

(3) Initial filling of a liquid injection recording apparatus is realized with a simple configuration.

In order to achieve the above-mentioned objects, the present invention adopts the following techniques.

As a technique for solving the problems with the liquid injection head, there is provided, in a first aspect, a liquid injection head comprising a nozzle body having a nozzle string including a plurality of nozzle holes, a plurality of pressure-generating chambers that are paired with the plurality of respective nozzle holes and communicated to the plurality of nozzle holes, a liquid supply system supplying a first liquid to the plurality of pressure-generating chambers, and an actuator placed adjacent to the plurality of pressure-generating chambers and driven to pressurize the plurality of pressure-generating chambers so that the first liquid in the plurality of pressure-generating chambers is injected from a nozzle injection port of the nozzle string, the liquid injection head including a nozzle guard that is formed so as to cover the nozzle string, the nozzle guard including: a top portion having a slit opposed to the nozzle string while being placed apart from a surface of the nozzle body; a sealing portion that seals an area between a peripheral edge of the top portion and the nozzle body; and a suction flow path in which a suction port is opened to a lower portion of the nozzle string, and is communicated to an inside space of the nozzle guard, in which: the inside space of the nozzle guard is rendered a negative pressure chamber by a suction portion connected to the suction flow path; and the first liquid overflowing the plurality of nozzle holes to the negative pressure chamber is sucked.

According to the present invention, excess liquid during the initial filling or during the ordinary use of liquid flows to a negative pressure chamber communicated to the outside only through a slit and gas outside the negative pressure chamber flows in the negative pressure chamber through the slit. Thus, the excess liquid moves through the negative pressure chamber under the condition of being unlikely to leak out from the slit and is sucked into a suction flow path through a suction port. Therefore, the space for collecting liquid flowing from the nozzle injection portion can be minimized, and the space factor of the liquid injection head and the degree of design freedom of the liquid injection recording apparatus can be enhanced.

Further, liquid can be discharged continuously through the suction flow path. Therefore, the ability of collecting excess liquid is very high, and the contamination with excess liquid can be prevented even when a great amount of excess liquid flows out and the liquid injection after the filling of liquid can be stabilized.

Further, it is not necessary to clean the nozzle surface with a wiper or to provide a service station provided with a cleaning device such as a wiper, and excess liquid can be collected with a nozzle guard, a suction flow path, and a suction port. Therefore, initial filling of a liquid injection recording apparatus can be realized with a simple configuration.

Further, in the liquid injection head, the suction port is provided at a position so as to be free from being opposed to the slit.

According to the present invention, air flowed through the slit reaches the suction port via an inside space, and hence the inside space can be depressurized rapidly and the negative pressure state in the negative pressure chamber can be continued satisfactorily. This enables excess liquid to be collected rapidly and a great amount of excess liquid to be collected stably.

Further, in the liquid injection head, the suction port is provided in a lowermost portion of the negative pressure chamber in a gravity direction.

According to the present invention, excess liquid can be sucked in the undermost portion, and hence excess liquid having flowed downward and reached the vicinity of the undermost portion can be sucked efficiently.

Further, in the liquid injection head, the slit is formed so that a longitudinal direction thereof faces in the gravity direction, and a lower end thereof being formed into a circular shape.

According to the present invention, even if excess liquid should leak outside from the slit, the surface of the liquid maintained by the surface tension at a lower end portion of the slit is unlikely to be broken and the excess liquid is likely to be accumulated in the negative pressure chamber. Therefore, the contamination by the leakage of the excess liquid can be prevented and the ability of collecting the excess liquid can be enhanced.

Further, in the liquid injection head, an inclined portion converging to the suction port is provided in an inside lower portion of the nozzle guard, and a width of the inclined portion, which is parallel to a surface of the nozzle body and perpendicular to the nozzle string, decreases gradually toward the suction port.

According to the present invention, excess liquid having reached the lower part of the negative pressure chamber flows toward the suction port in the width direction to reach the vicinity of the suction port, and hence the excess liquid is likely to be sucked by the suction portion. This enables the excess liquid to be sucked efficiently, which enhances the ability of collecting the excess liquid.

Further, in the liquid injection head, the inclined portion converging to the suction port is provided in the inside lower portion of the nozzle guard, and a distance of the inclined portion from the nozzle body in a direction perpendicular to a surface of the nozzle body decreases gradually toward the suction port.

According to the present invention, the distance between the nozzle body and the inclined portion in a direction perpendicular to the surface of the nozzle body becomes smaller toward the suction port. Therefore, excess liquid flowing downward through the inclined portion reaches the vicinity of the suction port. This enables the excess liquid to be sucked efficiently, which enhances the ability of collecting the excess liquid.

Further, in the liquid injection head, a water-repellent film is formed at least on an outer surface of the nozzle guard exposed to an outside.

According to the present invention, even if excess liquid should leak outside from the slit, the excess liquid is repelled by the water-repellent film to be likely to be accumulated in the negative pressure chamber. Therefore, the ability of collecting the excess liquid is enhanced and the contamination by the leakage of the excess liquid can be prevented.

Further, in the liquid injection head, a hydrophilic film is formed on an inner surface of the nozzle guard in contact with the negative pressure chamber.

According to the present invention, excess liquid is likely to flow through the negative pressure chamber and is unlikely to leak outside from the slit, and the excess liquid repelled by the water-repellent film is guided to the negative pressure chamber, and hence the excess liquid is likely to be accumulated in the negative pressure chamber without flowing out from the slit.

Further, in the liquid injection head, a dented portion dented toward the negative pressure chamber is formed in the top portion of the nozzle guard, and the slit is formed in a bottom surface of the dented portion.

According to the present invention, a slit is formed on the bottom surface of a dented portion. Therefore, even in the case where the nozzle guard comes into contact with a recording medium or the like, the probability of the contact with the water-repellent film in the vicinity of the slit is reduced to prevent the water-repellent film from being peeled.

Further, in the liquid injection head, an annular protruding wall that protrudes toward the negative pressure chamber and surrounds the slit in an annular shape is formed on the top portion of the nozzle guard.

According to the present invention, the annular protruding wall prevents excess liquid following the inner surface from being directed to the slit. Therefore, the excess liquid can be prevented from leaking from the slit. In particular, even if the excess liquid remains in the inside space after the negative pressure chamber has recovered a pressure in the case where liquid is injected to a recording medium with a nozzle injection portion of the liquid injection head being directed downward, the excess liquid can be prevented from leaking from the slit effectively.

In a second aspect, the present invention provides a liquid injection recording apparatus comprising the liquid injection head according to any one of the above-mentioned embodiments; and a liquid supply portion arranged so as to supply the first liquid to the liquid supply system.

According to the present invention, the first liquid is supplied to the liquid supply system, and hence the first liquid can be supplied, for example, as ink to the liquid injection head.

In a third aspect, the present invention provides a liquid injection recording apparatus comprising the liquid injection head according to any one of the above-mentioned embodiments; and a liquid supply portion arranged so as to switch and supply the first liquid and a second liquid to the liquid supply system.

According to the present invention, two kinds of liquids are supplied to the liquid supply system. Therefore, for example, ink and a cleaning solution are supplied to the liquid supply system so as to save the labor of the liquid injection head for cleaning and clean the head efficiently. This can recover the ability of collecting excess liquid.

Further, in the liquid injection recording apparatus of the second and third aspects, a re use liquid supply system collects the first liquid overflowing to the negative pressure chamber by suction, and supplies the first liquid to the pressure-generating chamber.

According to the present invention, the first liquid having leaked into the negative pressure chamber can be re-used.

Further, in the liquid injection recording apparatus of the second and third aspects, the re-use liquid supply system has one of a filter portion and a deaerator.

According to the present invention, the liquid in an appropriate state can be re-used.

In a fourth aspect, the present invention provides a method of filling a liquid injection head with liquid, the liquid injection head including a nozzle body having a nozzle string including a plurality of nozzle holes, a plurality of pressure-generating chambers that are paired with the plurality of respective nozzle holes and communicated to the plurality of nozzle holes, a liquid supply system supplying a first liquid to the plurality of pressure-generating chambers, and an actuator placed adjacent to the plurality of pressure-generating chambers and driven to pressurize the plurality of pressure-generating chambers so that the first liquid in the plurality of pressure-generating chambers is injected from a nozzle injection port of the nozzle string, the liquid injection head including a nozzle guard that is formed so as to cover the nozzle string, the nozzle guard including: a top portion having a slit opposed to the nozzle string while being placed apart from a surface of the nozzle body; a sealing portion that seals an area between a peripheral edge of the top portion and the nozzle body; and a suction flow path in which a suction port is opened to a lower portion of the nozzle string, and is communicated to an inside space of the nozzle guard, the inside space of the nozzle guard being rendered a negative pressure chamber by a suction portion connected to the suction flow path, the first liquid overflowing the plurality of nozzle holes to the negative pressure chamber being sucked, in which, under a condition that the negative pressure chamber is allowed to have a negative pressure lower than an atmospheric pressure by the suction portion, the plurality of pressure-generating chambers are filled with the first liquid under pressure with use of the liquid supply system.

According to the present invention, compared with the case where the plurality of pressure-generating chambers are filled with liquid under pressure with the inside space being under the same pressure as the atmospheric pressure, air flows through the slit continuously. Therefore, the excess liquid is unlikely to leak from the slit and the suction port discharges the excess liquid continuously, and hence the excess liquid is accumulated in the inside space (negative pressure chamber) without leaking from the slit. This enables the filling of liquid while preventing the contamination with excess liquid, which can stabilize the liquid injection after the filling of the liquid.

Further, in the method of filling a liquid injection head with liquid, the filling under pressure is completed under the condition that the negative pressure chamber is allowed to have a negative pressure lower than an atmospheric pressure by the suction portion.

According to the present invention, the filing under pressure is completed in the state of the negative pressure chamber and liquid does not flow to the negative pressure chamber. Therefore, compared with the case where the filling under pressure is completed in the plurality of pressure-generating chambers after the inside space recovers a pressure, excess liquid is unlikely to leak from the slit and does not leak from the slit. This enables the filling of liquid while preventing the contamination with excess liquid and can stabilize the liquid injection after the filling of the liquid.

Further, a method of using the liquid injection recording apparatus according to the present invention is a method of using the above-mentioned liquid injection recording apparatuses according to the present invention, and includes a liquid filling mode in which the suction portion is operated by a first output to render the inside space the negative pressure chamber so that the liquid leaking from the injection hole string via the suction flow path is sucked.

According to the above-mentioned configuration, the suction portion is operated by the first output, whereby a pressure sufficiently lower than the atmospheric pressure is achieved in the inside space of the injector guard in the negative pressure chamber. In this case, excess liquid that has been supplied from the liquid supply portion and leaked from the injection hole string during the initial filling of liquid and the ordinary use flows out to the negative pressure chamber communicated to the outside only through the slit and gas outside the negative pressure chamber flows into the negative pressure chamber through the slit. This allows the excess liquid to move to the negative pressure chamber under the condition that the excess liquid is unlikely to leak outside from the slit and allows the excess liquid to be sucked into the suction flow path from the suction port to be discharged outside. Therefore, the liquid having flowed from the injection hole string can be collected. Consequently, the initial filling of liquid can be performed while preventing the leakage of the excess liquid from the slit.

Further, the method of using the liquid injection recording apparatus according to the present invention includes switching a liquid filling mode in which the suction portion is operated by a first output to render the inside space the negative pressure chamber so that the liquid leaking from the injection hole string via the suction flow path is sucked, and a normal use mode in which the suction portion is operated by a second output smaller than the first output so that the liquid is injected from the injection hole string to the recording medium to perform recording with respect to the recording medium.

According to the above-mentioned configuration, in an ordinary operation mode, the suction portion is operated by the second output smaller than that in the liquid filling mode. Thus, even in the case where there are excess liquid having leaked from the injection holes during printing or the like and excess liquid remaining in the inside space of the injector guard after the filling of liquid, these excess liquids are sucked, whereby the leakage of excess liquid from the slit can be prevented. Accordingly, the initial filling of liquid to the printing can be performed under the condition that the opening direction of the injection holes is directed in the gravity direction without providing a service station.

According to the present invention, excess liquid during the initial filling of liquid and the ordinary use flows out to the negative pressure chamber communicated to outside only through the slit and gas outside of the negative pressure chamber flows into the negative pressure chamber. This allows the excess liquid to move through the negative pressure chamber under the condition that the excess liquid is unlikely to leak out from the slit and is sucked into the suction flow path from the suction port to be discharged outside. Therefore, the space for collecting liquid having flowed from the nozzle injection port is minimized, which can enhance the space factor of the liquid injection head and enhance the degree of design freedom of the liquid injection recording apparatus.

Further, liquid can be discharged continuously through the suction flow path. Therefore, even in the case where the ability of collecting excess liquid is very high and a great amount of excess liquid flows out, the contamination with the excess liquid can be prevented and the liquid injection after the filling of the liquid can be stabilized.

Further, it is not necessary to clean the nozzle surface with a wiper or to provide a service station, and excess liquid can be collected with a nozzle guard, a suction flow path, and a suction portion. Therefore, initial filling of a liquid injection recording apparatus can be realized with a simple configuration.

DETAILED DESCRIPTION OF THE PREFERRED EMBODIMENTS

Hereinafter, embodiments of the present invention are described with reference to the drawings.

(Liquid Injection Recording Apparatus)

Figure 1:
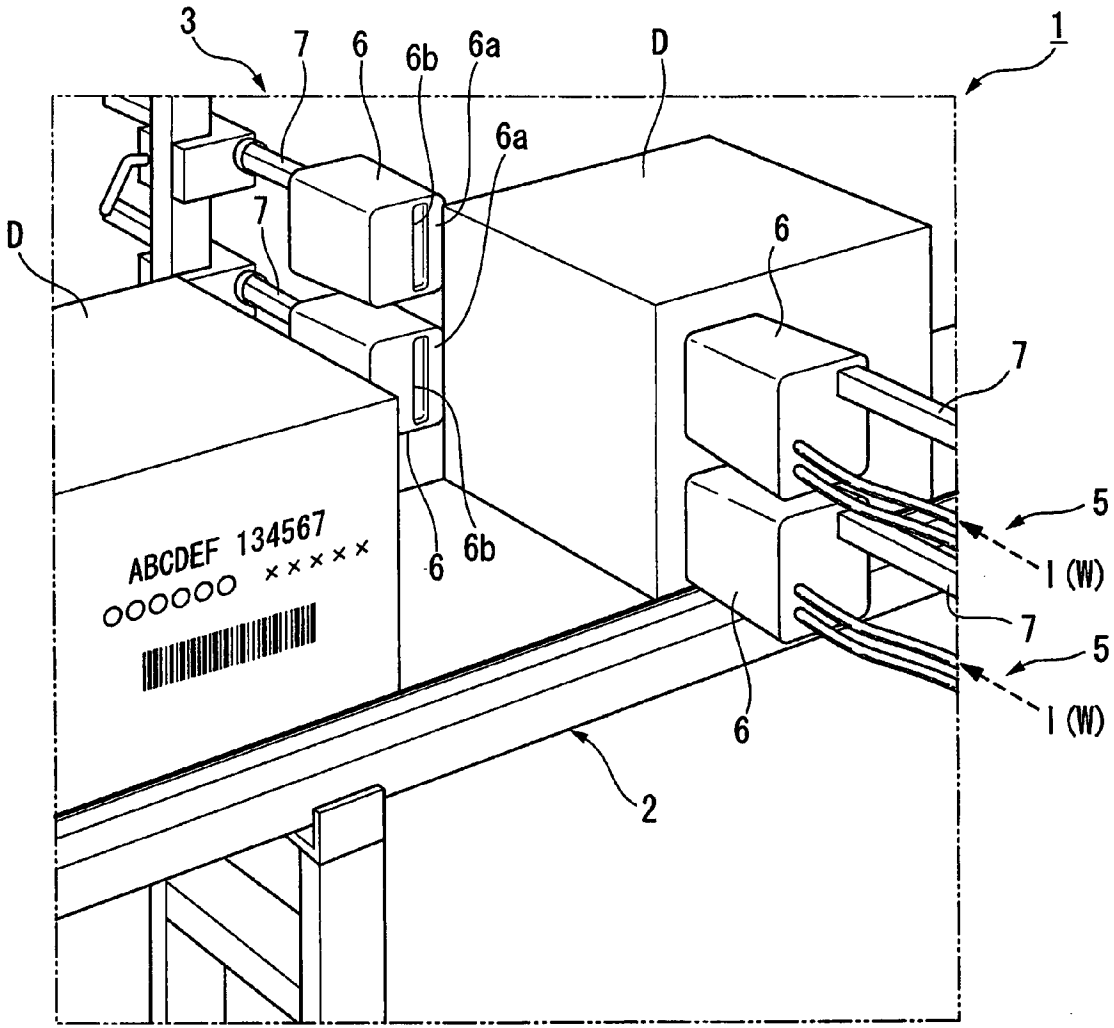
FIG. 1 is a perspective view illustrating an inkjet recording apparatus 1 in an embodiment of the present invention.
Figure 2:
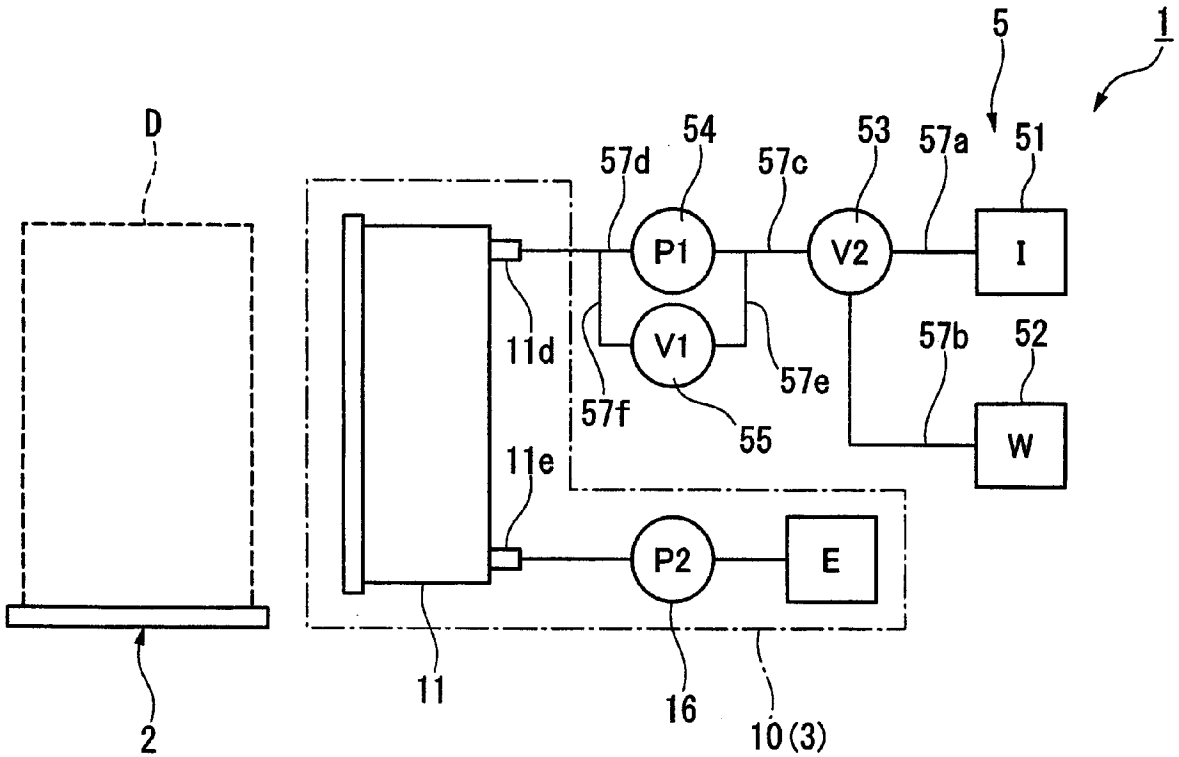
FIG. 2 is a schematic structural view of the inkjet recording apparatus 1 viewed from a right side surface in the embodiment of the present invention, with a part of the configuration being illustrated in a cross-section.

FIG. 1 is a perspective view illustrating an inkjet recording apparatus (liquid injection recording apparatus) 1 according to an embodiment of the present invention. FIG. 2 is a schematic structural view of the inkjet recording apparatus 1. The inkjet recording apparatus 1 is connected to a predetermined personal computer, and discharges (injects) ink (liquid) I based on printing data sent from the personal computer to perform printing on a box D. The inkjet recording apparatus 1 includes a belt conveyer 2 for conveying the box D in one direction, an ink discharge portion 3 having a plurality of inkjet heads 10, and an ink supply portion 5 for supplying ink (first liquid) I and a cleaning solution (second liquid) W to the inkjet heads 10, as illustrated in FIG. 2.

The ink discharge portion 3 discharges the ink I to the box D, and has four housings 6 in a rectangular solid shape, as illustrated in FIG. 1. The inkjet heads 10 are respectively accommodated in the housings 6 (see FIG. 2). Two housings 6 are provided on both sides of the belt conveyer 2 in the width direction with each ink discharge surface 6*a* directed to the belt conveyer 2 side. Two housings 6 placed respectively on both sides of the belt conveyer 2 in the width direction are provided adjacent to each other in a vertical direction and are supported respectively by a support member 7. An opening 6*b* is formed on the ink discharge surface 6*a* of the housing 6.

(Liquid Injection Head)

Figure 3:
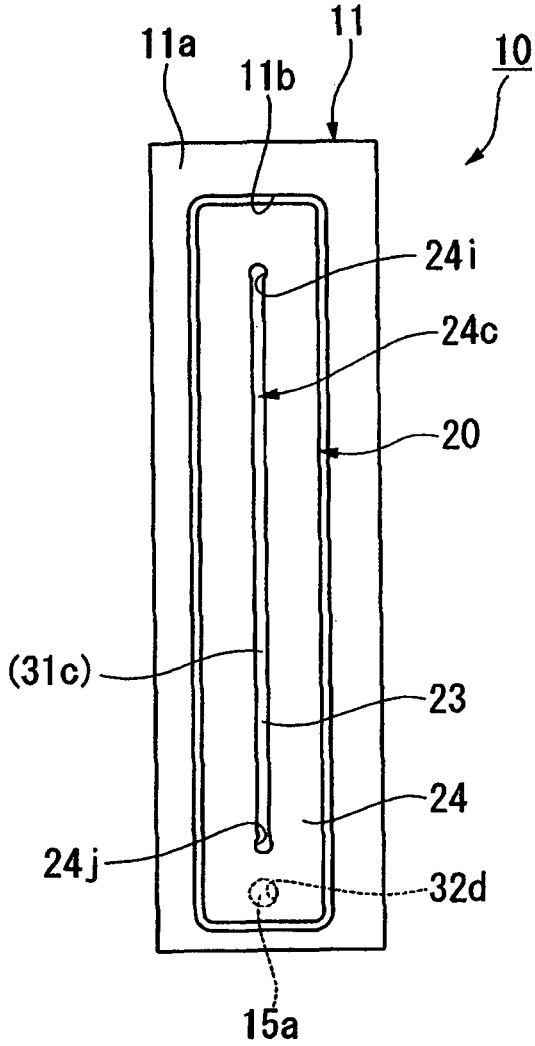
FIG. 3 is a front view of an inkjet head 10 in the embodiment of the present invention.
Figure 4:
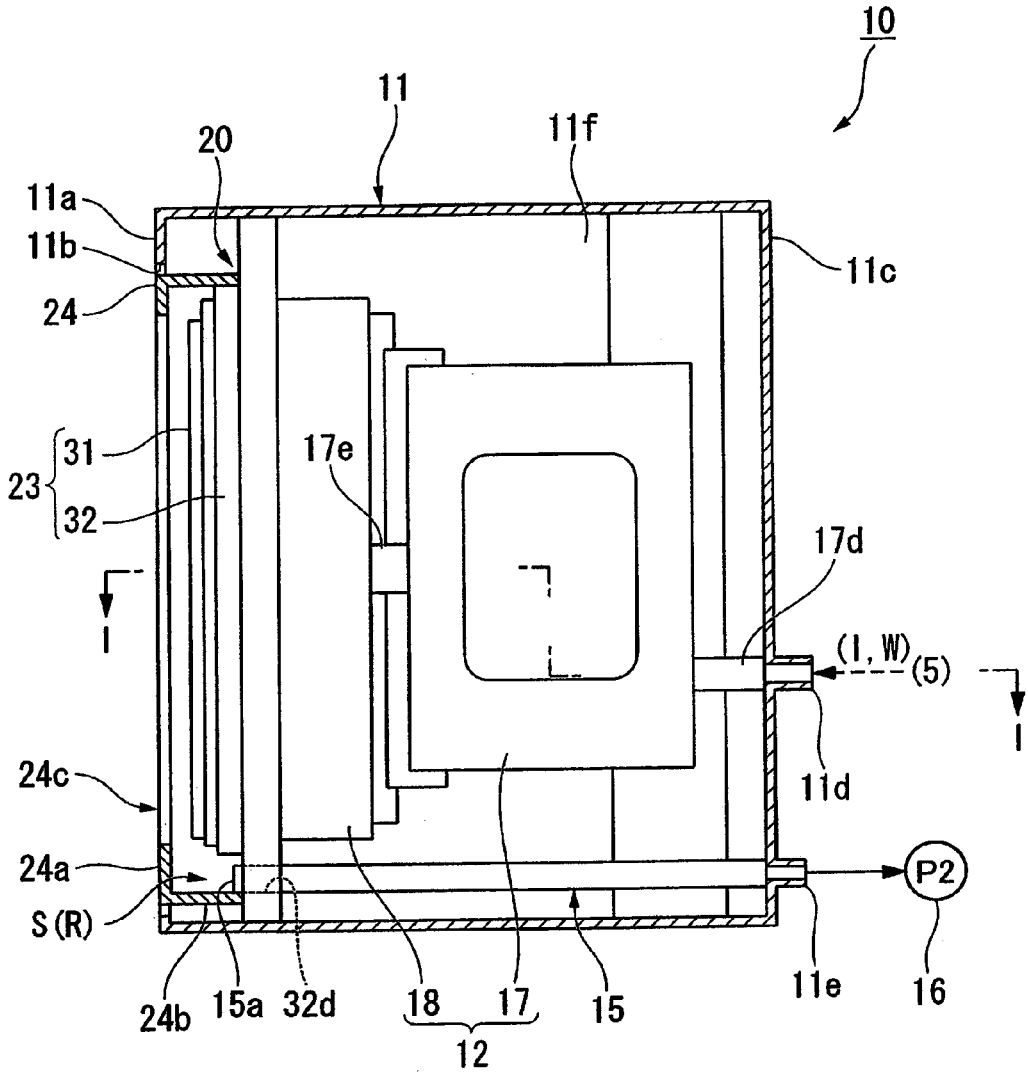
FIG. 4 is a schematic structural view of the inkjet head 10 viewed from a right side surface in the embodiment of the present invention.
Figure 5:
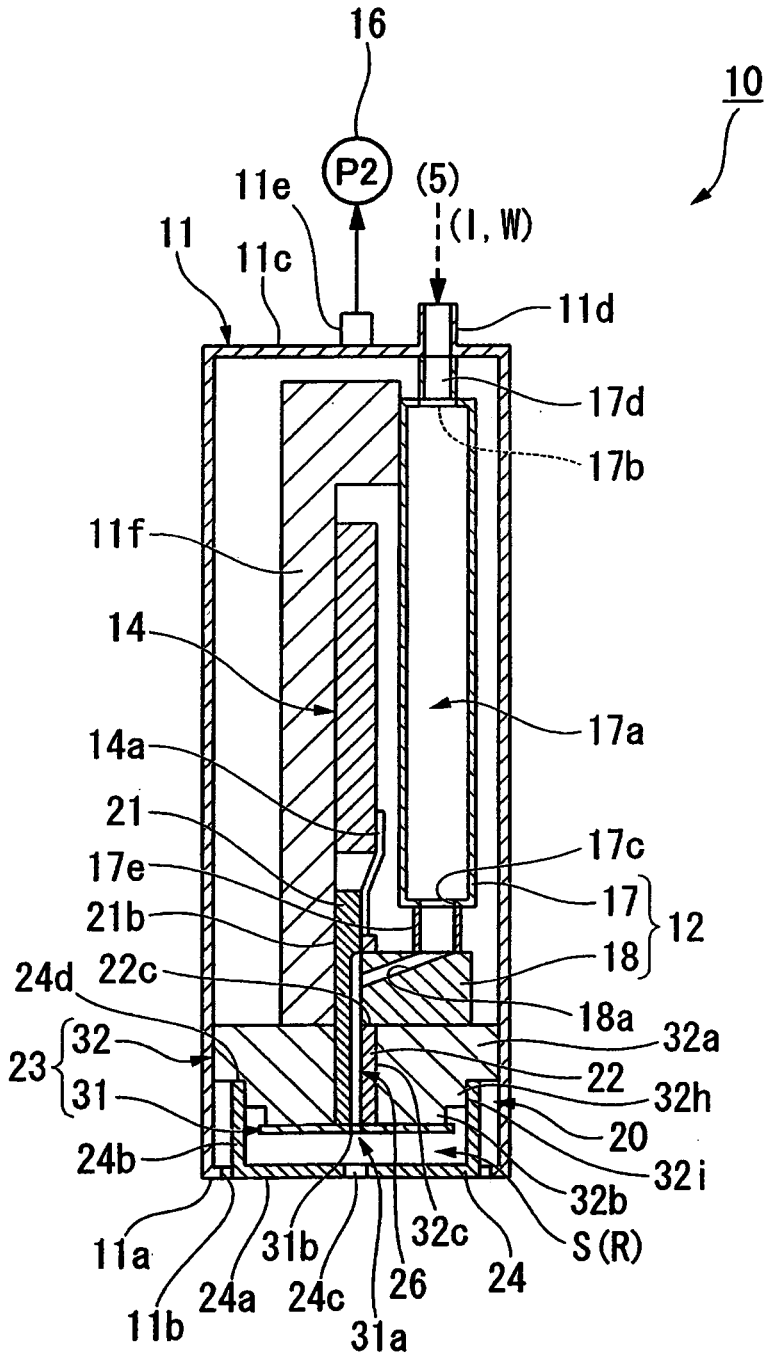
FIG. 5 is a cross-sectional view taken along a line I-I in FIG. 4 in the embodiment of the present invention.

FIG. 3 is the front view of an inkjet head 10, and FIG. 4 is a schematic structural view of the inkjet head 10 viewed from a right side surface. FIG. 5 is a cross-sectional view taken along a line I-I in FIG. 4.

As illustrated in FIG. 4, the inkjet head 10 includes a case 11, a liquid supply system 12, a head chip 20, a driving circuit board 14 (see FIG. 5), and a suction flow path 15.

The case 11 has a thin box shape with an exposure hole 11*b* formed on a front surface 11*a*, and the case 11 is fixed in the housing 6 with the thickness direction directed in a horizontal direction and the exposure hole 11*b* directed to the opening 6*b*. As illustrated in FIGS. 4 and 5, the case 11 is provided with a through-hole passing through the inner space at a back surface 11*c*. Specifically, an ink injection hole 11*d* is formed at a position in the substantially middle in the height direction and an ink suction hole 11*e* is formed in a lower part. The case 11 includes a base plate 11*f* that rises and is fixed to the case 11 in the inner space and accommodates each constituent element of the inkjet head 10.

The liquid supply system 12 is communicated to the ink supply portion 5 via the ink injection hole 11*d* and is substantially composed of a damper 17 and an ink flow path substrate 18.

As illustrated in FIG. 5, the damper 17 adjusts the fluctuation of a pressure of the ink I and includes a storage chamber 17*a* for storing the ink I. The damper 17 is fixed to the base plate 11*f*, and includes an ink in-take hole 17*b* connected to the ink injection hole 11*d* via a tube member 17*d* and an ink discharge hole 17*c* connected to the ink flow path substrate 18 via the tube member 17*e*.

As illustrated in FIG. 4, the ink flow path substrate 18 is a member formed into an elongated shape. As illustrated in FIG. 5, the ink flow path substrate 18 includes a flow passage 18*a* communicated to the damper 17, through which the ink I flows, and is attached to the head chip 20.

As illustrated in FIG. 5, the driving circuit board 14 includes a control circuit (not shown) and a flexible substrate 14*a*. The driving circuit board 14 applies a voltage to a ceramic piezoelectric plate 21 in accordance with a printing pattern, when one end of the flexible substrate 14*a* is connected to a plate-shaped electrode 18 (described later) and the other end is connected to the control circuit (not shown) on the driving circuit board 14. The driving circuit board 14 is fixed to the base plate 11*f*.

Figure 6:
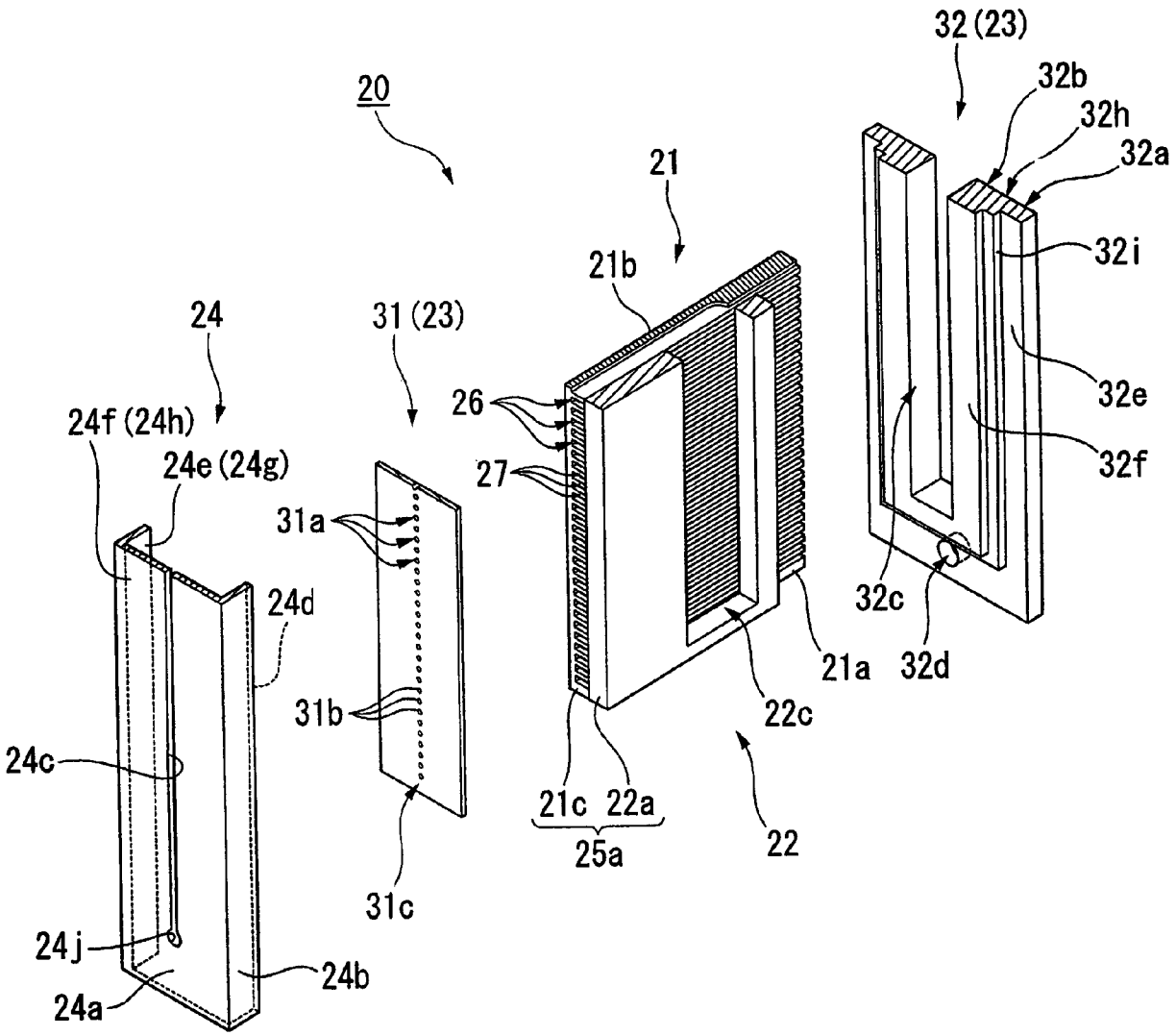
FIG. 6 is an exploded perspective view of a head chip 20 in the embodiment of the present invention.

As illustrated in FIG. 6, the head chip 20 includes the ceramic piezoelectric plate (actuator) 21, the ink chamber plate 22, a nozzle body 23, and a nozzle guard 24.

Figure 7:
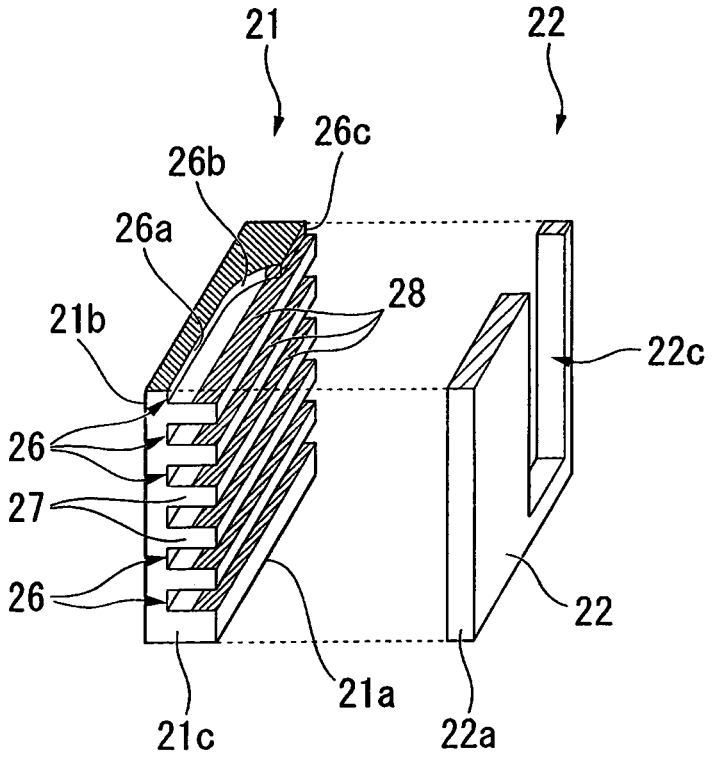
FIG. 7 is an exploded perspective view illustrating the details of a ceramic piezoelectric plate 21 and an ink chamber plate 22 in the embodiment of the present invention.

The ceramic piezoelectric plate 21 is a substantially rectangular member made of lead zirconate titanate (PZT), and as illustrated in FIGS. 6 and 7, a plurality of long grooves 26 are provided in parallel on one plate surface 21*a* of two plate surfaces 21*a*, 21*b*, and the respective long grooves 26 are partitioned by side walls 27.

As illustrated in FIG. 6, the long grooves (pressure-generating chambers) 26 extend in a short direction of the ceramic piezoelectric plate 21, and a plurality of the long grooves 26 are provided in parallel over the full length of the ceramic piezoelectric plate 21 in the longitudinal direction. As illustrated in FIG. 7, each long groove 26 is formed into a rectangular shape in a cross-section in the thickness direction of the piezoelectric actuator. Further, a bottom surface of each long groove 26 is composed of a front flat surface 26*a* extending to substantially the center portion in the short direction from a front side surface 21*c* of the ceramic piezoelectric plate 21, an inclined surface 26*b* whose groove depth becomes smaller from the back portion of the front flat surface 26*a* to a back side surface, and a back flat surface 26*c* extending from the back portion of the inclined surface 26*b* to the back side surface.

Each long groove 26 is formed by a disk-shaped dice cutter.

A plurality of the side walls 27 are formed in parallel in the longitudinal direction of the ceramic piezoelectric plate 21, and partition the long grooves 26. On the opening side (plate surface 21*a* side) of the long grooves 26 on both wall surfaces of each side wall 27, plate electrodes 28 for applying a driving voltage extend in the short direction of the ceramic piezoelectric plate 21. The plate electrode 28 is formed by known vapor deposition from an oblique direction. The plate electrode 28 is connected to the above-mentioned flexible substrate 14*a*.

As illustrated in FIG. 5, the ceramic piezoelectric plate 21 has the back side surface of the plate surface 21*b* fixed to the edge of the base plate 11*f*, and directs the extending direction of the long grooves 26 to the exposure hole 11*b*.

Returning to FIGS. 6 and 7, the ink chamber plate 22 is a member in a substantially rectangular plate shape in the same way as in the ceramic piezoelectric plate 21, and the size in the longitudinal direction is substantially the same and the size in the short direction is set to be shorter, compared with the sizes of the ceramic piezoelectric plate 21. The ink chamber plate 22 has an opening 22*c* passing through in the thickness direction and formed in the longitudinal direction of the ink chamber plate 22.

The ink chamber plate 22 can be formed of a ceramic plate, a metal plate, or the like. However, considering the deformation after the connection to the ceramic piezoelectric plate 21, a ceramic plate with a similar thermal expansion coefficient is used.

As illustrated in FIG. 6, the ink chamber plate 22 is connected to the ceramic piezoelectric plate 21 from the plate surface 21*a* side so that the front side surface 22*a* forms an abutting surface 25*a* to be flush with the front side surface 21*c* of the ceramic piezoelectric plate 21. In this connection state, the opening 22*c* exposes a plurality of long grooves 26 of the ceramic piezoelectric plate 21 as a whole, and all the long grooves 26 are opened outward and the respective long grooves are communicated to each other.

As illustrated in FIG. 5, the ink flow path substrate 18 is attached to the ink chamber plate 22 so as to cover the opening 22*c*, and the flow passage 18*a* of the ink flow path substrate 18 and each long groove 26 are communicated to each other.

As illustrated in FIG. 5, the nozzle body 23 is configured by attaching a nozzle plate 31 to a nozzle cap 32.

As illustrated in FIG. 6, the nozzle plate 31 is an elongated member in a thin plate shape made of polyimide, and a plurality of nozzle holes 31*a* passing therethrough in the thickness direction are arranged in parallel to form a nozzle string (row) 31*c*. More specifically, the nozzle holes 31*a* as the same number of the long grooves 26 are formed at the position in the middle in the short direction of the nozzle plate 31 on the same line and at the same interval as that of the long grooves 26.

Among the two plate surfaces of the nozzle plate 31, the plate surface, on which nozzle discharge ports (nozzle injection ports) 31*b* for discharging the ink I are opened, is coated with a water-repellent film having water-repellency for preventing the adhesion of ink and the like, and the other plate surface is connected to the butting surface 25*a* and the nozzle cap 32.

The nozzle holes 31*a* are formed with use of an excimer laser apparatus.

The nozzle cap 32 is a member having a shape obtained by scraping the outer peripheral edge of one of two frame surfaces of the frame plate shaped member, and includes an outer frame portion 32*a* in a thin plate shape, a middle frame portion 32*h* that is thicker than the outer frame portion 32*a*, an inner frame portion 32*b* that is thicker than the middle frame portion 32*h*, a long hole 32*c* passing therethrough in the thickness direction and extending in the longitudinal direction in the middle portion in the short direction of the inner frame portion 32*b*, and a discharge hole 32*d* passing therethrough in the thickness direction at one end of the outer frame portion 32*a*. In other words, the middle frame portion 32*h* and the inner frame portion 32*b* protrude in the thickness direction in steps from the outer frame surface 32*e* of the outer frame portion 32*a*, and the cross-sectional contour in the thickness direction has a stepped shape in such a manner that the heights of the outer frame portion 32*a*, the middle frame portion 32*h*, and the inner frame portion 32*b* increase in this order toward the long hole 32*c*.

The nozzle plate 31 is attached to the inner frame surface 32*f* extending in the same direction as that of the outer frame surface 32*e* so as to close the long hole 32*c*. The nozzle guard 24 abuts against the outer frame surface 32*e* and an inside surface 32*i* extending in the orthogonal direction of the outer frame surface 32*e*.

The nozzle body 23 is accommodated in the inside space of the case 11 so that the discharge hole 32*d* of the nozzle cap 32 is positioned on the lower side (see FIG. 3), and is fixed to the case 11 and the base plate 11*f* (see FIG. 5).

In this state, the ceramic piezoelectric plate 21 and the ink chamber plate 22 are partially inserted in the long hole 32*c*, and the abutting surface 25*a* abuts against the nozzle plate 31. The nozzle plate 31 is attached to the inner frame surface 32*f* with an adhesive, and compared with the area of the inner frame surface 32*f*, the nozzle plate 31 is formed to be larger, whereby the nozzle plate 31 extends off slightly from the inner frame surface 32*f*.

According to such a configuration, when a predetermined amount of ink I is supplied to the ink flow path substrate 18 from the storage chamber 17*a* in the damper 17, the supplied ink I is sent into the long grooves 26 via the opening 22*c*. The gaps between the ink chamber plate 22 and the long grooves 26, which are generated on the back flat surface 26*c* side of the long grooves 26 (see FIG. 7), are sealed with a sealing member.

(Nozzle Guard)

The nozzle guard 24 is a member in a substantially box shape made of stainless steel and is formed by press forming. The nozzle guard 24 includes a top portion 24*a* formed into a rectangular plate shape and a sealing portion 24*b* extending in a direction substantially orthogonal to a plate surface direction from the peripheral edge of the top portion 24*a*.

The top portion 24*a* has a plate surface that has substantially the same size as that of the inner frame surface 32*f*, and includes a slit 24*c* extending in the longitudinal direction in the middle portion in the short direction of the top portion 24*a*. The slit 24*c* is formed slightly longer than the nozzle string 31*c* and both ends (upper end 24*i* and lower end 24*j*) of the slit 24*c* are formed into a circular shape.

The width of the slit 24*c* is set to be about 1.5 mm with respect to a nozzle diameter of 40 μm of the nozzle holes 31*a*. It is desired that the width of the slit 24*c* is set to be in a range from the width at which the ink I does not leak to run during the initial filling with the ink I to the width at which a negative pressure can be obtained by the suction pump 16.

Further, the upper end 24*i* and the lower end 24*j* are formed into a circular shape with a diameter slightly larger than the above-mentioned widths.

In the nozzle guard 24, an inner surface 24*e* facing the inside is coated with a hydrophilic film 24*g* by titanium coating. On an outer surface 24*f* opposed to the inner surface 24*e* and the inner surface of the slit 24*c*, a ware-repellent film 24*h* is formed by fluorine resin coating or Teflon (registered trademark) plating.

The nozzle guard 24 is attached to the nozzle cap 32 by attaching the annular end 24*d* to the outer frame surface 32*e* with an adhesive so that the top portion 24*a* covers the inner frame portion 32*b* and the discharge hole 32*d* (see FIG. 3) and that the inner surface 24*e* in the sealing portion 24*b* abuts against the inside surface 32*i* of the inner frame portion 32*h* (see FIG. 5). In this state, the nozzle guard 24 covers the nozzle string 31*c* via a space (inside space) S so that the slit 24*c* is opposed to the nozzle string 31*c* and is not opposed to the discharge hole 32*d*. In other words, the nozzle guard 24 covers the nozzle discharge ports 31*b* so as to border on the nozzle string 31*c* through the slit 24*c* and does not border on the discharge hole 32*d* in the opening direction of the slit 24*c*.

It is desired that the distance between the top portion 24*a* of the nozzle guard 24 and the nozzle plate 31 is set to be in a range from the distance at which the ink I does not leak from the slit 24*c* during the initial filling with the ink I to the distance at which a negative pressure can be obtained by the suction pump 16.

As illustrated in FIG. 4, the suction flow path 15 is configured in such a manner that one end of a tube to be a suction port 15*a* is inserted in the discharge hole 32*d* to be fixed and the other end thereof is connected to the ink suction hole 11*e*. As described above, the suction port 15*a* is opened at a position not opposed to the slit 24*c*.

The suction pump 16 is connected to the ink suction hole 11*e* via a tube. The suction pump 16 sucks the air and the ink I in the space S to form the space S into the negative pressure chamber R during operation. The suction pump 16 stores the sucked ink I in a liquid waste tank E (see FIG. 2).

Returning to FIG. 2, the ink supply portion 5 includes an ink tank 51 storing the ink I, a cleaning solution tank 52 storing a cleaning solution W, a switch valve 53 capable of switching two flow paths, a pressure pump 54 for supplying the ink I or the cleaning solution W to the inkjet head 10 under pressure, and an open/close valve 55 capable of opening/closing the flow path.

The ink tank 51 is communicated to the pressure pump 54 via a supply tube 57*a*, the switch valve 53, and a supply tube 57*c*, and the cleaning solution tank 52 is communicated to the pressure pump 54 via a supply tube 57*b*, the switch valve 53, and the supply tube 57*c*. More specifically, the supply tubes 57*a*, 57*b* are connected to the switch valve 53 as inflow tubes and the supply tube 57*c* is connected to the switch valve 53 as an outflow tube.

The pressure pump 54 is communicated to the inkjet head 10 via a supply tube 57*d* when the supply tube 57*c* is connected to the pressure pump 54, and supplies the ink I or the cleaning solution W flowed therein from the supply tube 57*c* to the inkjet head 10. The pressure pump 54 functions as an open/close value so as not to allow a fluid to flow during a non-operation time.

The open/close valve 55A is connected to a supply tube 57*e* that is communicated to the supply tube 57*c* and is to be an inflow tube and a supply tube 57*f* that is communicated to the supply tube 57*d* and is to be an outflow tube. That is, when the open/close valve 55 is opened, the supply tubes 57*e* and 57*f* function as bypass tubes of the pressure pump 54.

Next, the operation of the inkjet recording apparatus 1 with the above-mentioned configuration is described. In the following description, the case where printing is performed on the box D after the inkjet head 10 is initially filled with the ink I is described, and further, the case where the inkjet head 10 is cleaned is described.

(Ink Initial Filling)

Figure 8:
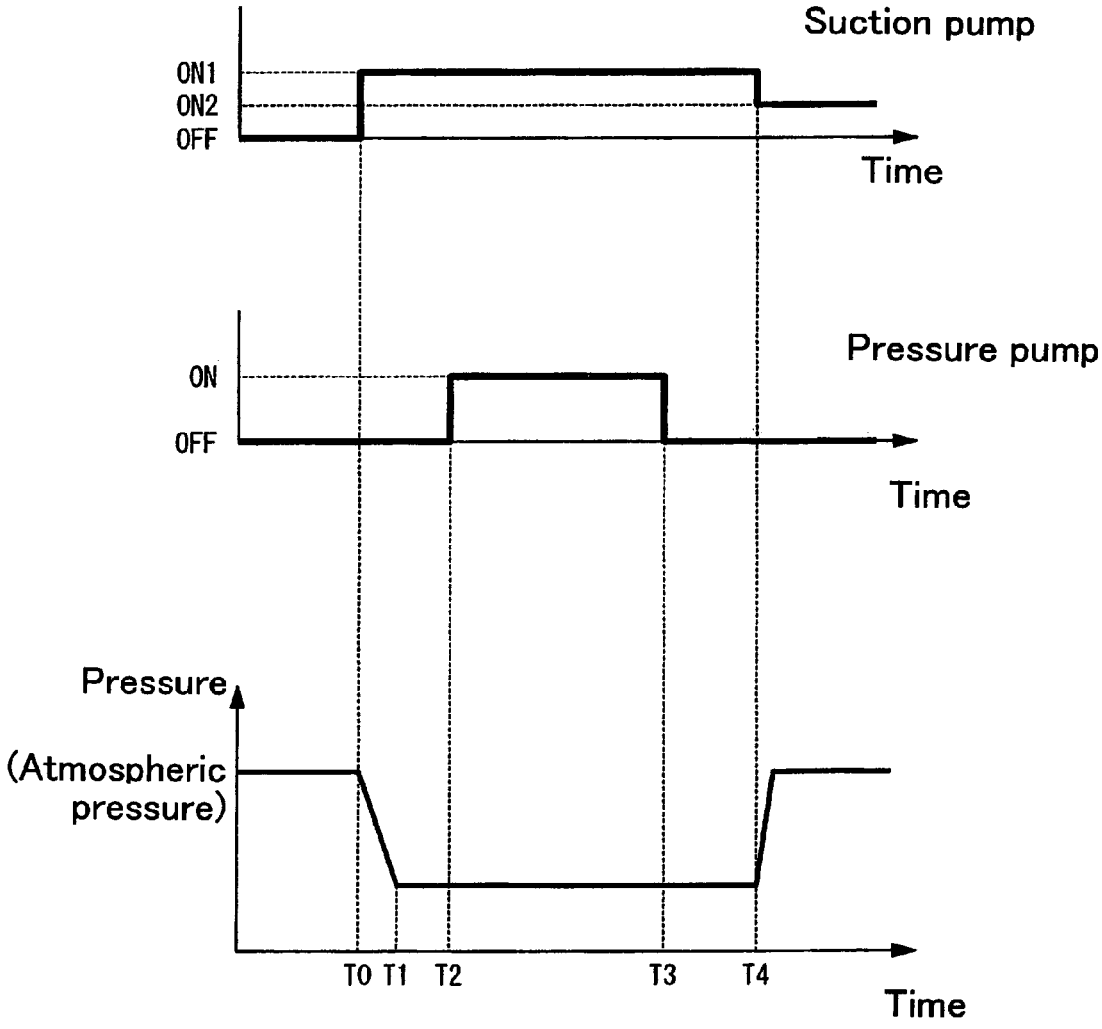
FIG. 8 is a diagram illustrating a relationship between the operation timing of a suction pump (section) 16 and a pressure pump 54, and a space S (negative pressure chamber R) in the embodiment of the present invention.

FIG. 8 is a diagram illustrating a relationship between the operation timing of the suction pump 16 and the pressure pump 54 and the space S (negative pressure chamber R), and FIG. 9 are cross-sectional views of the head chip 20 illustrating the operation thereof during the initial filling, with main portions enlarged.

First, as illustrated in FIGS. 4 and 8, the suction pump 16 is operated (ON1), and the suction pump 16 sucks the air in the space S through the suction port 15*a* via the suction flow path 15 (time T0 in FIG. 8). At this time, it is preferred that the output of the operated suction pump 16 is set to be such that the space S has a sufficiently negative pressure, and the output at this time is set to be the filling output of the suction pump 16. When the suction pump 16 is operated with the filling output (first output), outside air flows in the space S through the slit 24*c*. The air is sucked after reaching the suction port 15*a* via the space S, whereby the space S is depressurized (liquid filling mode). Then, after the elapse of a predetermined time T1, the negative pressure chamber R is obtained in which the space S has a negative pressure sufficiently lower than the atmospheric pressure.

After the space S becomes the negative pressure chamber R, the ink supply portion 5 fills the inkjet head 10 with the ink I under pressure (time T2 in FIG. 8). At this time, the ink supply portion 5 is set as follows. That is, as illustrated in FIG. 2, the supply tube 57*a* and the supply tube 57*c* are communicated to each other by the switch valve 53, and the switch valve 55 is closed, whereby the supply tube 57*e* and the supply tube 57*f* are disconnected. When the pressure pump 54 is operated in this state, the pressure pump 54 injects the ink I to the ink injection hole 11*d* of the inkjet head 10 from the ink tank 51 via the supply tubes 57*a*, 57*c*, and 57*d*.

As illustrated in FIGS. 4 and 5, the ink I injected to the ink injection hole 11*d* flows in the storage chamber 17*a* via the ink in-take hole 17*b* of the damper 17, and then, flow out to the flow passage 18*a* of the ink flow path substrate 18 via the ink discharge hole 17*c*. Then, the ink I flowed in the passage path 18*a* flows in each long groove 26 via the opening hole 22*c*.

Figures 9A, 9B, 9C, 9D:
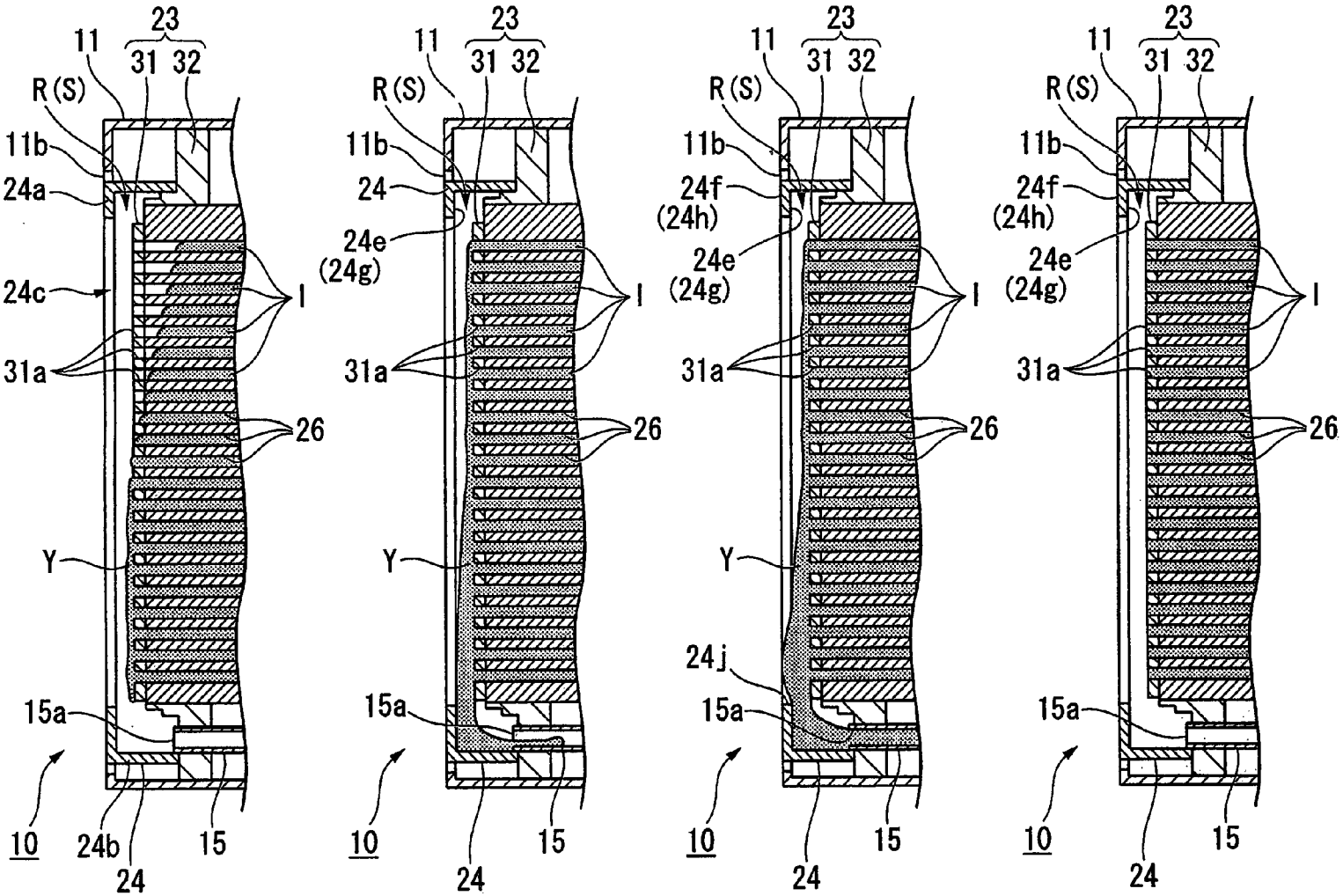
FIGS. 9A to 9D are cross-sectional views illustrating the operation of the head chip 20 during the initial filling in the embodiment of the present invention, with main portions enlarged.

After the ink I flowed in each long groove 26 flows to the nozzle holes 31*a* side to reach the nozzle holes 31*a*, the ink I flows out of the nozzle holes 31*a* as excess ink Y, as illustrated in FIG. 9A. When the excess ink Y starts flowing, the amount thereof is small. Therefore the excess ink Y flows downwardly on the nozzle plate 31. The ink I having reached the lower portion of the negative pressure chamber R is sucked by the suction flow path 15 from the suction port 15*a* and is discharged to the liquid waste tank E (see FIG. 9B).

When the outflow amount of the excess ink Y increases, as illustrated in FIG. 9B, the excess ink Y starts flowing also downwardly on the inner surface 24*e* of the nozzle guard 24, as well as on the nozzle plate 31. At this time, air flows in the negative pressure chamber R continuously from the slit 24*c*, and the excess ink Y is unlikely to flow out from the slit 24*c*. As illustrated in FIG. 9C, even if the amount of the excess ink Y flowing on the inner surface 24*e* in the vicinity of the slit 24*c* increases locally, and a part of the excess ink Y reaches the vicinity of the outer surface 24*f* against the air flowing in from the slit 24*c*, the excess ink Y is repelled by the water-repellent film 24*h* formed on the outer surface 24*f*. The repelled ink I is induced to the hydrophilic film 24*g* formed on the inner surface 24*e* and returned to the negative pressure chamber R again.

Further, at the lower end 24*j* of the slit 24*c*, the surface tension acts on the ink I at the circular outline of the lower end 24*j* (border between the outer surface 24*f* and the lower end 24*j*). At the lower end 24*j*, a strong surface tension acts on the ink I, and the balance of the surface tension is kept. Therefore, the surface of the ink I is not broken and the ink I does not leak outside. Further, in the same way as mentioned above, the ink is induced by the water-repellent film 24*h* formed on the outer surface 24*f* and the hydrophilic film 24*g* formed on the inner surface 24*e* to be returned to the negative pressure chamber R.

Thus, the excess ink Y flowing out of the nozzle holes 31*a* is discharged to the liquid waste tank E continuously.

As illustrated in FIG. 8, after the elapse of a predetermined time T3, the pressure pump 54 is stopped to complete the filling with the ink I under pressure. The excess ink Y does not flow out of the nozzle holes 31*a* along with the stop of the pressure pump 54, and the excess ink Y remaining in the negative pressure chamber R is discharged to the liquid waste tank E via the suction port 15*a*.

Then, after the elapse of a predetermined time T4, the suction pump 16 is stopped. After the completion of the filling with the ink I, as illustrated in FIG. 9D, the long grooves 26 are filled with the ink I. The space S recovers a pressure to have the same pressure as the atmospheric pressure (see FIG. 8).

(During Printing)

The operation in the case of performing printing on the box D is described. First, the setting of the ink supply portion 5 is described. More specifically, as illustrated in FIG. 2, the supply tubes 57*a* and 57*c* are communicated by the switch valve 53, and under this condition, the open/close valve 55 is opened to communicate the supply tube 57*e* with the supply tube 57*f*. In this state, the pressure pump 54 is not operated, and therefore the supply tube 57*c* and the supply tube 57*d* are not communicated to each other via the pressure pump 54. In this state, the ink I is injected to the ink injection hole 11*d* of the inkjet head 10 via the supply tubes 57*a*, 57*c*, 57*e*, 57*f*, and 57*d*.

When the belt conveyer 2 is driven under the condition that the ink supply portion 5 is set as described above (see FIG. 1), and the box D is conveyed in one direction and passes through the front portion of the housing 6, that is, when the box D passes through the front portion of the nozzle plate 31 (nozzle holes 31*a*), the ink discharge portion 3 discharges ink droplets to the box D.

Specifically, based on the printing data input by an outside personal computer, the driving circuit board 14 selectively applies a voltage to a predetermined plate electrode 28 in accordance with the printing data. This decreases the capacity of the long grooves 26 corresponding to the plate electrode 28, and the ink I filling the long grooves 26 is discharged from the discharge port 31*b* to the box D.

The long grooves 26 have a negative pressure when the ink I is discharged, and hence the long grooves 26 are filled with the ink I via the supply tubes 57*a*, 57*c*, 57*e*, 57*f*, and 57*d*.

Thus, the ceramic piezoelectric plate 21 of the inkjet head 10 is driven in accordance with image data, and the ink droplets are discharged from the nozzle holes 31*a* to be dropped on the box D. Thus, the ink droplets are discharged continuously from the ink jet head 10 while the box D is being moved, whereby an image (character) is printed at a desired position of the box D.

Herein, the inkjet head 10 of this embodiment is configured in such a manner that the string direction of the nozzle string 31*c* is directed in the gravity direction, and the opening direction of the nozzle holes 31*a* is directed in the horizontal direction. However, the present invention is not limited thereto, and as the configuration in which the opening direction of the nozzle holes 31*a* is directed in the gravity direction, the configuration in which the extending direction of the nozzle string 31*c* is directed in the horizontal direction is also considered.

In such a case, the opening direction of the discharge ports 31*b* of the nozzle holes 31*a* is directed in the gravity direction, and hence the excess ink Y having leaked from the nozzle holes 31*a* during the filling with the ink I may not be sucked completely to remain in a boundary portion between the top portion 24*a* and the sealing portion 24*b* of the nozzle guard 24 or the like. Further, after the filling with the ink I, the excess ink Y may leak from the nozzle holes 31*a*, for example, during printing.

As illustrated in FIG. 8, in this embodiment, the suction pump 16 is operated at all times even after the filling with the ink I (ON2 in FIG. 8). In this case, the output of the suction pump 16 is set to be weaker than the output (filling output) during the filling with the ink I to such a degree as to suck the excess ink Y present in the space S sufficiently during printing (normal use mode). As a result, the space S becomes a negative pressure space weaker than that during the filling with the ink I. It is not preferred that the output of the suction pump 16 is too strong, because the fly path of the ink droplets discharged from the nozzle holes 31*a* is influenced during printing, which may influence the printing precision. Then, the output of the suction pump 16 is set to be an ordinary output (second output).

When printing is performed while the suction pump 16 is operated at an ordinary output, the excess ink Y having leaked from the nozzle holes 31*a* and the excess ink Y remaining on the inner surface 24*e* of the nozzle guard 24 flow toward each suction flow path 15. The ink I having reached the suction flow path 15 is sucked into the suction flow path 15 to be discharged to the liquid waste tank E.

The operation of ON2 in FIG. 8 described as an normal use mode is not necessarily required to be carried out together with the operation of ON1 in FIG. 8 described as the liquid filling mode, and may be carried out as appropriate depending upon the operation environment in the surrounding and the kind of the ink I.

(During Cleaning)

The operation of the inkjet head 10 during cleaning is described. First, the setting of the ink supply portion 5 is described. That is, as illustrated in FIG. 2, the supply tubes 57*b* and 57*c* are communicated by the switch valve 53, and the open/close valve 55 is closed to close the supply tubes 57*e* and 57*f*. In this state, the pressure pump 54 is operated. The pressure pump 54 injects the cleaning solution W to the ink injection hole 11*d* of the inkjet head 10 from the cleaning solution tank 52 via the supply tubes 57*b*, 57*c*, and 57*d*.

In the same way as in the initial filling, the cleaning solution W is allowed to flow out of the nozzle holes 31*a* via the long grooves 26 and the like, and the cleaning solution W having flowed is sucked from the suction port 15*a*.

If the inkjet recording apparatus 1 has not been used for a long period of time, the ink I filling the long grooves 26 is dried to be cured. In this case, if the inkjet head 10 is filled with the cleaning solution W in the same way as in the cleaning, the inkjet recording apparatus 1 can be stored for a long period of time.

As described above, according to the inkjet recording apparatus 1, the excess ink Y moves through the negative pressure chamber R under the condition that it is unlikely to leak out from the slit 24*c* in the inkjet head 10, and is sucked from the suction port 15*a* to the suction flow path 15 to be discharged outside. Therefore, the space for collecting the ink I having flowed from the nozzle discharge ports 31*b* can be minimized, and the space factor of the inkjet head 10 can be enhanced, which can also enhance the degree of design freedom of the inkjet recording apparatus 1.

Further, a great amount of the excess ink Y can be discharged continuously via the suction flow path, and hence the ability of collecting the ink Y is enhanced, and the contamination with the excess ink Y can be prevented and the discharge of the ink I after the filling with the ink I can be stabilized.

Further, the initial filling with the inkjet recording apparatus 1 can be realized with a simple configuration without providing a service station.

Further, the suction port 15*a* is disposed so as not to be opposed to the slit 24*c*, and the air flowing in from the slit 24*c* reaches the suction port 15*a* via the space S (negative pressure chamber R). Therefore, the space S can be depressurized rapidly, and the negative pressure state of the negative pressure chamber R can be continued satisfactorily. Thus, the excess ink Y can be collected smoothly, and a great amount of the excess ink Y can be collected stably.

Further, the suction port 15*a* is formed in the lowermost portion of the negative pressure chamber R in the gravity direction, and the ink I is sucked in the lower most portion. Therefore, the excess ink Y flowing in the lower portion can be sucked efficiently.

Further, the water-repellent film 24*h* is formed on the outer surface 24*f*. Therefore, even if the excess ink Y in the negative pressure chamber R should flow out from the slit 24*c*, the excess ink Y is repelled by the water-repellent film 24*h* and is likely to be accumulated in the negative pressure chamber R.

Further, the hydrophilic film 24*g* is formed on the inner surface 24*e*. Therefore, the ink I is likely to flow through the negative pressure chamber R, and the excess ink Y repelled by the water-repellent film 24*h* is guided to the negative pressure chamber R and is likely to be accumulated in the negative pressure chamber R. This can prevent the excess ink Y from flowing out from the slit 24*c* at a high probability.

Further, since the lower end 24*j* of the slit 24*c* has a circular shape, the surface of the ink I maintained at the lower end 24*j* due to the surface tension is unlikely to be broken and the excess ink Y is likely to be accumulated in the negative pressure chamber R. More specifically, first, the ink I having reached the lower end 24*j* of the slit 24*c* comes into contact with the lower end 24*j*. At this time, the surface tension acts on the ink I on the circular outline of the lower end 24*j* (border between the outer surface 24*f* and the lower end 24*j*). Herein, the liquid (ink I) is present in a substantially spherical shape in an environment in which an outer force does not act strongly. Therefore, in the case where the end of the slit 24*c* has a rectangular shape, the surface of a substantially spherical body maintained due to the surface tension is broken and the ink I may leak out of the slit 24*c*.

On the other hand, in the case where the end of the slit 24*c* has a circular shape as in this embodiment, the surface of the liquid (ink I) maintained due to the surface tension is not broken, and the ink I is likely to be accumulated in the negative pressure chamber R without leaking out at the lower end 24*j*. Further, in the same way as described above, the water-repellent film 24*h* is formed on the outer surface 24*f*, and hence the ink I that should leak can be accumulated in the negative pressure chamber R.

If such a configuration is adopted, as described above, even if the excess ink Y should leak out from the slit 24*c*, the ink I is likely to be accumulated in the negative pressure chamber R at the lower end 24*j* of the slit 24*c*. Therefore, the contamination by the leakage of the excess ink Y can be prevented and the ability of collecting the excess ink Y can be enhanced.

Further, the ink supply portion 5 is configured so as to switch and supply the ink I and the cleaning solution W, and the ink I and the cleaning solution W are supplied to the liquid supply system 12. This reduces the labor for cleaning of the inkjet head 10, and allows the inkjet head 10 to perform cleaning efficiently.

Further, as described above, this embodiment is characterized by the configuration in which the space S (negative pressure chamber R) is formed using the nozzle guard 24 formed so as to cover the nozzle string 31*c* and the excess ink Y is discharged from the suction port 15*a*. Hereinafter, the feature of the configuration is described below.

In the present configuration, the space S has a negative pressure sufficiently lower than the atmospheric pressure to become the negative pressure chamber R, and the ink I flowing to the negative pressure chamber R is unlikely to flow toward the slit 24*c*. Under this condition, the filling with the ink I under pressure is started. Therefore, compared with the case where the long grooves 26 are filled with the ink I under pressure with the space S having the same pressure as the atmospheric pressure, e.g., the case where the nozzle guard 24 and the space S are not formed, the air flows in from the slit 24*c* continuously, and hence the excess ink Y is unlikely to leak from the slit 24*c*. Further, since the excess ink Y is discharged continuously by the suction port 15*a*, the excess ink Y is accumulated in the space S (negative pressure chamber R) without leaking out from the slit 24*c*.

Further, under the condition that the space S is the negative pressure chamber R, the filling under pressure is completed, therefore the liquid does not flow out to the negative pressure chamber R. Therefore, compared with the case where the filling of the long grooves 26 under pressure is completed after the space S recovers a pressure, the excess ink Y is unlikely to leak out from the slit 24*c* and does not overflow the slit 24*c*. This enables the filling with the ink I while preventing the contamination with the excess ink Y, and can stabilize the discharge of the ink I after the filling.

Modified Examples

Hereinafter, specific modified examples of the inkjet head 10 are described with reference to the drawings. The same components as those of the inkjet head 10 are denoted with the same reference numerals as those therein, and the description thereof is omitted.

Figure 10B:
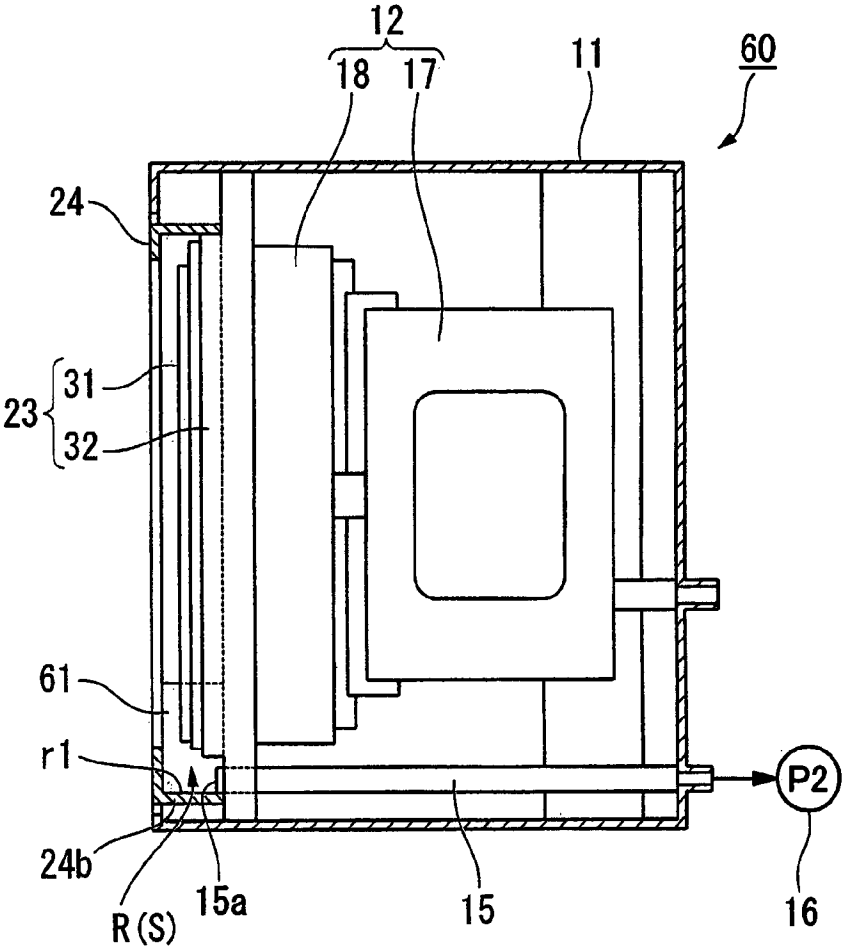
FIGS. 10A and 10B are views illustrating an inkjet head 60 which is a modified example of the inkjet head 10 in the embodiment of the present invention, with main portions enlarged.
Figure 10A:
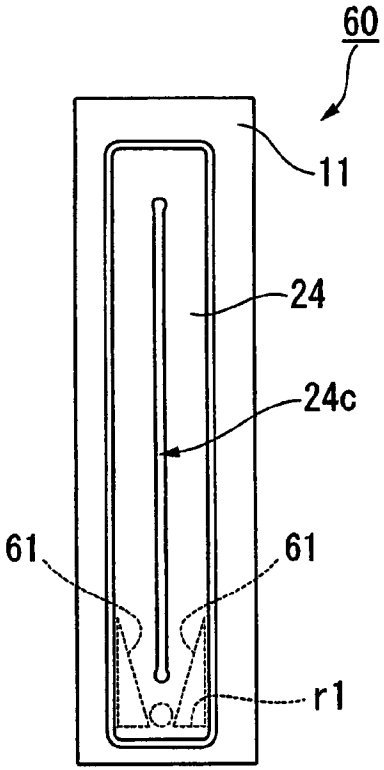

FIGS. 10A and 10B are views illustrating an inkjet head 60 that is a modified example of the inkjet head 10. The inkjet head 60 includes two inclined portions 61 at a bottom rl of the negative pressure chamber R.

The inclined portions 61 are respectively made of a triangular member having a right triangle shape in a cross-section, and are arranged in such a manner that two rectangular side surfaces forming a right angle abut against the sealing portion 24*b*, the right angle portion formed by two rectangular side surfaces is allowed to abut against one of two corners formed by the sealing portion 24*b*, and the rectangular side surface opposed to the right angle portion forms an inclined surface converging to the suction port 15*a*. Due to such a configuration, the width of the lower portion of the negative pressure chamber R (width in the direction parallel to the surface of the nozzle plate 31 and perpendicular to the nozzle string 31*c*) gradually decreases toward the suction port 15*a*.

According to such a configuration, the excess ink Y having reached the lower portion of the negative pressure chamber R flows toward the suction port 15*a* in the width direction, and hence the excess ink Y is likely to be sucked from the suction port 15*a*.

Figure 11B:
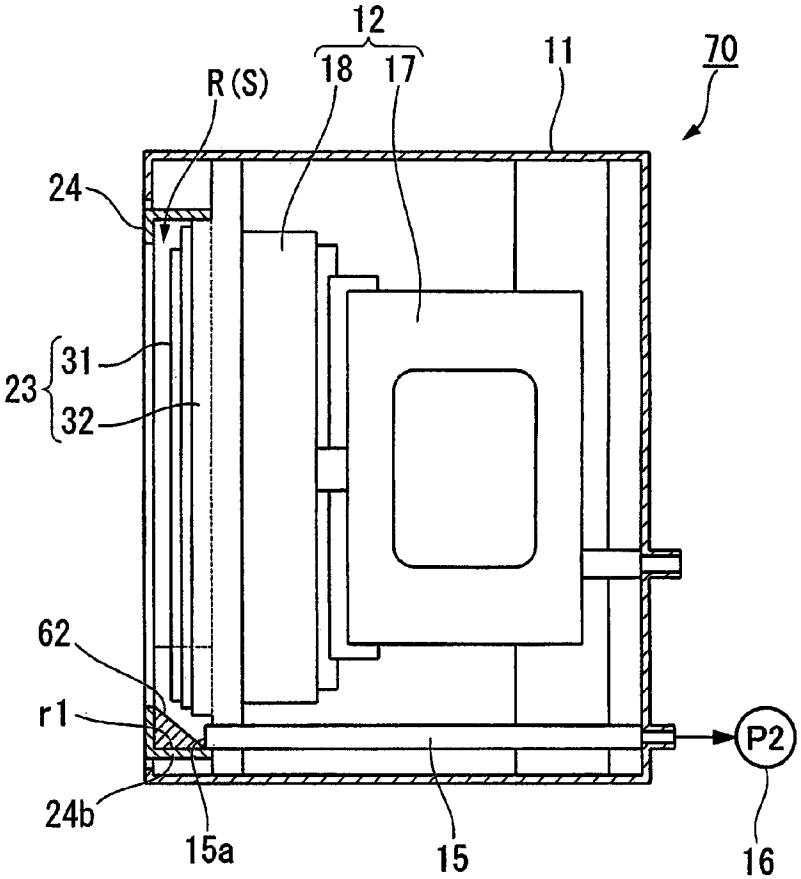
FIGS. 11A and 11B are views illustrating an inkjet head 70 which is a modified example of the inkjet head 10 in the embodiment of the present invention, with main portions enlarged.
Figure 11A:
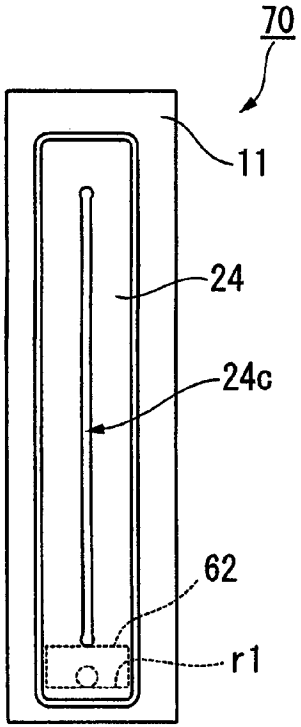

FIG. 11 are views illustrating an inkjet head 70 that is a modified example of the inkjet head 10. The inkjet head 70 includes two inclined portions 62 at a bottom rl of the negative pressure chamber R.

An inclined portion 62 is made of a triangular member having a right triangle shape in a cross-section, and the inclined portion 62 is arranged in such a manner that a corner portion formed at a right angle abuts against the corner formed by the top portion 24*a* and the sealing portion 24*b*, and the inclined surface opposed to the corner portion converges to the suction port 15*a*. Due to such a configuration, the distance between the nozzle plate 31 and the top portion 24*a* gradually decreases toward the suction port 15*a* in the direction perpendicular to the surface of the nozzle plate 31.

According to such a configuration, the excess ink Y having reached the lower portion of the negative pressure chamber R flows toward the suction port 15*a* in the opening direction of the suction port of the negative pressure chamber R, and hence the excess ink Y is likely to be sucked from the suction port 15*a*.

Figure 12A:
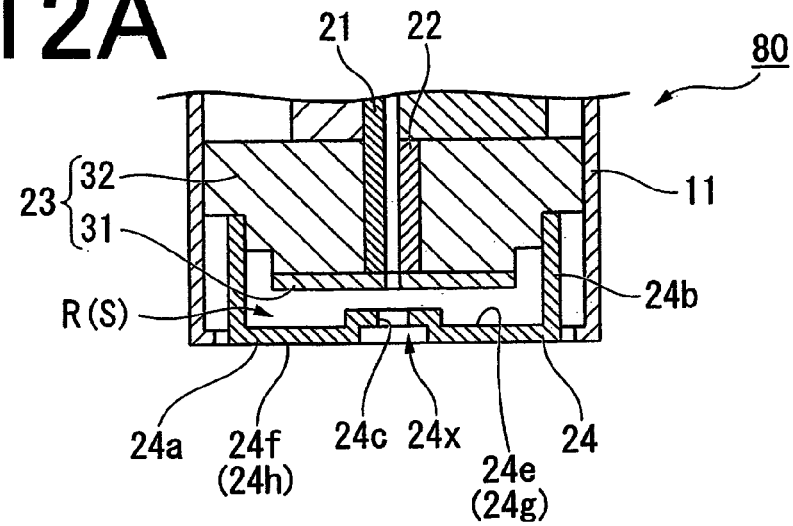
FIGS. 12A to 12C are views illustrating inkjet heads 80, 90, and 100 which are modified examples of the inkjet head 10 in the embodiment of the present invention, with main portions enlarged.

FIG. 12A is a view illustrating an inkjet head 80 that is a modified example of the inkjet head 10. As illustrated in FIG. 12A, the nozzle guard 24 of the inkjet head 80 has a dented portion 24*x* dented to the negative pressure chamber R side on the top portion 24*a*. The dented portion 24*x* is formed by press forming (rolling), and the bottom surface of the dented portion 24*x* has the slit 24*c*. Thus, even in the case where the nozzle guard 24 comes into contact with the box D, the water-repellent film 24*h* in the vicinity of the slit 24*c* reduces the probability at which the water-repellent film 24*h* comes into contact with the box D, whereby the water-repellent film 24*h* can be prevented from being peeled off.

Figure 12B:
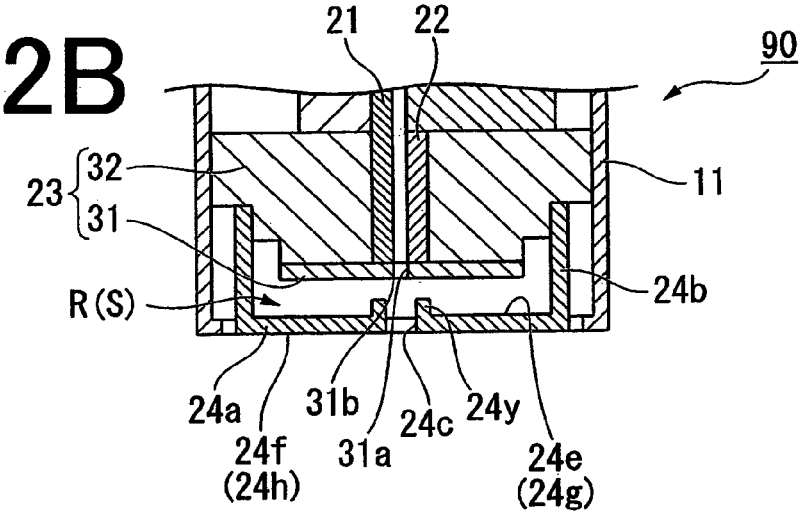

FIG. 12B is a view illustrating an inkjet head 90 that is a modified example of the inkjet head 10. As illustrated in FIG. 12B, the nozzle guard 24 of the inkjet head 90 has an annular protruding wall 24*y* protruding to the negative pressure chamber R side and surrounding the slit 24*c* in an annular shape. Thus, in the case where the ink I is discharged to the box D with the nozzle discharge port 31*b* of the inkjet head 90 directed downward, even if the excess ink Y remains in the space S after the negative pressure chamber R recovers a pressure, the excess ink Y is prevented from reaching the slit 24*c* through the inner surface 24*e*, and the excess ink Y can be prevented from leaking from the slit 24*c*.

Figure 12C:
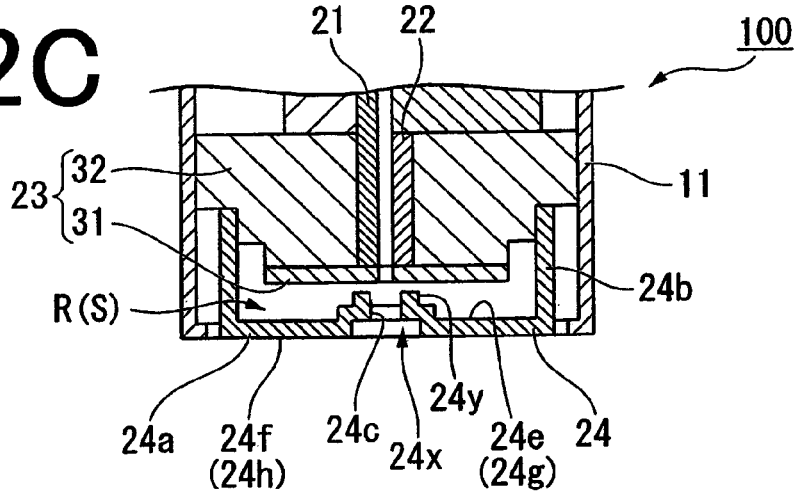

FIG. 12C is a view illustrating an inkjet head 100 that is a modified example of the inkjet head 10. As illustrated in FIG. 12C, on the nozzle guard 24 of the inkjet head 100, a dented portion 24*x* and an annular protruding wall 24*y* are formed by press forming. This can prevent the water-repellent film 24*h* from peeling and can prevent the excess ink Y from leaking from the slit 24*c* in the case of discharging the ink I to the box D with the nozzle discharge port 31*b* of the inkjet head 100 directed downward.

Press forming enables the dented portion 24*x* and the annular protruding wall 24*y* to be formed simultaneously and renders the production yield satisfactory.

The operation order or various shapes, combinations, and the like of the respective constituent elements illustrated in the above-mentioned embodiments are illustrated for illustrative purposes, and can be varied based on the design request and the like within the range not deviating from the spirit of the present invention.

For example, in the above-mentioned embodiments, as illustrated in FIG. 2, the suction pump 16 and the liquid waste tank E are provided inside the inkjet head 10. However, the present invention is not limited thereto. More specifically, the suction pump 16 and the liquid waste tank E may be provided outside the inkjet head 10, and may be mounted on, for example, the inkjet recording apparatus 1.

For example, in the above-mentioned embodiments, the nozzle body 23 is composed of the nozzle plate 31 and the nozzle cap 32, and the annular end 24*d* of the nozzle guard 24 is allowed to adhere to the nozzle cap 32. However, the annular end 24*d* may be allowed to adhere to the nozzle plate 31 provided that the suction port 15*a* is opened in the space S.

In the above-mentioned embodiments, the suction port 15*a* is inserted in the discharge hole 32*d* formed in the nozzle cap 32. However, the discharge hole 32*d* may be formed in the nozzle plate 31 or the nozzle guard 24, or the suction flow path 15 may be connected to the discharge port 32*d* to be used as the suction port.

Further, in the above-mentioned embodiment, the water-repellent film 24*h* is formed by fluorine resin coating or Teflon (registered trademark) plating. However, a water-repellent sheet may be attached or a water-repellent agent may be applied.

Further, in the above-mentioned embodiment, the hydrophilic film 24*g* is formed by titanium coating. However, the hydrophilic film 24*g* may be subjected to gold plating or may be coated with an alkali drug.

Further, in the above-mentioned embodiment, the inkjet recording apparatus 1 is configured with the inkjet head 10 fixed. However, the inkjet recording apparatus 1 can also be configured with the inkjet head 10 being set to be movable. That is, by adopting the inkjet head 10, an inkjet recording apparatus requiring no cap for negative pressure suction can be realized.

Further, in the above-mentioned embodiments, the string direction of the nozzle string 31*c* of the inkjet head 10 is directed in the gravity direction, and the opening direction of the nozzle holes 31*a* is directed in the horizontal direction. However, the present invention is not limited to such a setting direction. The opening direction of the nozzle holes 31*a* may be directed in the gravity direction, and the extending direction of the nozzle string 31*c* may be directed in the horizontal direction.

Further, in the above-mentioned embodiments, the suction pump is operated during the initial filling and the cleaning. However, the ink I may be collected during the printing because the ink may run from the nozzle holes 31*a*.

Further, in the above-mentioned embodiments, the inclined portions 61 and 62 that are members separate from the nozzle guard 24 are provided. However, the inner surface 24*e* of the nozzle guard 24 may be inclined to obtain an inclined portion instead of providing the inclined portions 61 and 62.

Further, the inclined portions 61 and 62 may be used in a superimposed manner. That is, a member may be provided, which gradually decreases the width of the lower portion of the negative pressure chamber R and the distance between the nozzle plate 31 and the top portion 24*a* toward the lower portion, or the inner surface 24*e* may be formed into such a shape.

Further, in the above-mentioned embodiments, the dented portion 24*x* and the annular protruding wall 24*y* are formed by press forming. However, the dented portion 24*x* and the annular protruding wall 24*y* may be formed by other processing methods such as cutting.

Further, in the head chip 20 in the above-mentioned embodiments, as illustrated in FIGS. 6 and 7, the opening 22*c* is opened to the entire long grooves 26. However, the present invention is not limited thereto. For example, slits communicated to the long grooves 26 alternately may be formed in the ink chamber plate 22, whereby the long grooves into which the ink I is guided and the long grooves 26 into which the ink I is not guided may be formed. By adopting such a configuration, even when conductive ink I is used, for example, the plate electrodes 28 of the adjacent side walls 27 are not short-circuited, whereby independent ink discharge can be realized.

That is, the form of the head chip described in the above-mentioned embodiments is not limited. Therefore, non-conductive oil-based ink, conductive water-based ink, solvent ink, UV ink, or the like may be used. By configuring the liquid injection head as described above, ink of any properties can be used appropriately. In particular, conductive ink can be used without any problem, and hence, the added value of the liquid injection recording apparatus can be enhanced. The other elements can exhibit similar functional effects.

In the above-mentioned embodiments, the ceramic piezoelectric plate 21 having electrodes is provided as an actuator for discharging the ink I. However, the present invention is not limited to this embodiment. For example, air bubbles may be generated in a chamber filled with the ink I with use of an electrothermal conversion element, so as to discharge the ink I by the pressure thereof.

Further, in the above-mentioned embodiments, the inkjet printer 1 has been illustrated as an example of the liquid injection recording apparatus. However, the liquid injection recording apparatus is not limited to the printer. For example, the liquid injection recording apparatus may be a facsimile, an on-demand printing machine, or the like.

Further, in the above-mentioned embodiments, as in the configuration illustrated in FIG. 2, the excess ink Y sucked by the suction pump 16 is discharged to the liquid waste tank E. However, the present invention is not limited thereto. For example, an ink tank 51, instead of the liquid waste tank, may be connected to the flow path on the exit side of the suction pump 16. That is, the excess ink Y sucked by the suction pump 16 may be supplied to the ink tank 51, and may be supplied as the ink I from the ink tank 51 to the inkjet head 10. By adopting such an embodiment, the excess ink Y can be re-used as the ink I.

Further, in addition to the above-mentioned configuration, a filter member may be provided in a flow path extending from the suction pump 16 to the ink tank 51 for re-using the excess ink Y. By adopting such a configuration, impurities contained in the excess ink Y can be removed, and ink in an appropriate state can be supplied to the ink tank 51.

Further, for re-using the excess ink Y, a deaerator may be provided in a flow path extending from the suction pump 16 to the ink tank 51. By adopting such a configuration, air bubbles contained in the excess ink Y can be deaerated and ink in an appropriate deaerated state can be supplied to the ink tank 51.

However, the above-mentioned configurations are not necessarily required, and may be used appropriately depending upon the specification of the liquid injection recording apparatus.

What is claimed is:

1. A liquid injection head comprising:

a nozzle body having a row of nozzle, holes;

a plurality of pressure-generating chambers each communicating with a respective one of the nozzle holes;

a liquid supply system that supplies a first liquid to the plurality of pressure-generating chambers;

an actuator placed adjacent to the plurality of pressure-generating chambers and configured to be driven to pressurize the plurality of pressure-generating chambers so that the first liquid in the plurality of pressure-generating chambers is injected from a nozzle injection port of the row of nozzle holes; and a nozzle guard that is formed so as to cover the row of nozzle holes, the nozzle guard comprising:

a top portion located spaced from a surface of the nozzle body and having a slit opposed to the row of nozzle holes;

a sealing portion that seals an area between a peripheral edge of the top portion and the nozzle body; and a suction flow path having a suction port open below the row of nozzle holes and communicating with an inside space of the nozzle guard;

wherein a suction section connected to the suction flow path of the nozzle guard causes the inside space of the nozzle guard to be a negative pressure chamber; and wherein the first liquid overflowing into the negative pressure chamber is sucked from the nozzle holes.

2. A liquid injection head according to claim 1; wherein the suction port of the suction flow path is provided at a position so as to not oppose the slit.

3. A liquid injection head according to claim 1; wherein the suction port is provided in a lowermost portion of the negative pressure chamber in a gravity direction.

4. A liquid injection head according to claim 1; wherein the slit of the nozzle guard is formed so that a longitudinal direction thereof faces in the gravity direction and a lower end thereof is formed into a circular shape.

5. A liquid injection head according to claim 1; wherein an inclined portion converging to the suction port is provided in an inside lower portion of the nozzle guard; and wherein a width of the inclined portion, which is parallel to a surface of the nozzle body and perpendicular to the nozzle string, decreases gradually toward the suction port.

6. A liquid injection head according to claim 1; wherein an inclined portion converging to the suction port is provided in an inside lower portion of the nozzle guard; and wherein a distance of the inclined portion from the nozzle body in a direction perpendicular to a surface of the nozzle body decreases gradually toward the suction port.

7. A liquid injection head according to claim 1; further comprising a water-repellent film formed at least on an outer surface of the nozzle guard.

8. A liquid injection head according to claim 1; further comprising a hydrophilic film formed on an inner surface of the nozzle guard in contact with the negative pressure chamber.

9. A liquid injection head according to claim 1; further comprising a dented portion dented toward the negative pressure chamber and formed in the top portion of the nozzle guard; and wherein the slit is formed in a bottom surface of the dented portion.

10. A liquid injection head according to claim 1; further comprising an annular protruding wall formed on the top portion of the nozzle guard so as to protrude toward the negative pressure chamber and surround the slit in an annular shape.

11. A liquid injection recording apparatus comprising:

a liquid injection head according to claim 1; and a liquid supply portion arranged so as to supply the first liquid to the liquid supply system of the liquid injection head.

12. A liquid injection recording apparatus according to claim 11; further comprising a re-use liquid supply system that collects the first liquid overflowing to the negative pressure chamber by suction, and that supplies the first liquid to the plurality of pressure-generating chambers.

13. A liquid injection recording apparatus according to claim 12; wherein the re-use liquid supply system has one of a filter portion and a deaerator.

14. A liquid injection recording apparatus comprising:

a liquid injection head according to claim 1; and a liquid supply portion arranged so as to switch and supply the first liquid and a second liquid to the liquid supply system of the liquid injection head.

15. A liquid injection recording apparatus according to claim 14; further comprising a re-use liquid supply system that collects the first liquid overflowing to the negative pressure chamber by suction, and that supplies the first liquid to the plurality of pressure-generating chambers.

16. A liquid injection recording apparatus according to claim 15; wherein the re-use liquid supply system has one of a filter portion and a deaerator.

17. A method of filling a liquid injection head with liquid, comprising:

providing a liquid injection head comprising:

a nozzle body having a row of nozzle holes;

a plurality of pressure-generating chambers each communicating with a respective one of the nozzle holes;

a liquid supply system that supplies a first liquid to the plurality of pressure-generating chambers;

an actuator placed adjacent to the plurality of pressure-generating chambers and configured to be driven to pressurize the plurality of pressure-generating chambers so that the first liquid in the plurality of pressure-generating chambers is injected from a nozzle injection port of the row of nozzle holes; and a nozzle guard that is formed so as to cover the row of nozzle holes, the nozzle guard comprising:

a top portion located spaced from a surface of the nozzle body and having a slit opposed to the row of nozzle holes;

a sealing portion that seals an area between a peripheral edge of the top portion and the nozzle body; and a suction flow path having a suction port open below the row of nozzle holes and communicating with an inside space of the nozzle guard, a suction section connected to the suction flow path of the nozzle guard causing the inside space of the nozzle guard to be a negative pressure, and the first liquid overflowing into the negative pressure chamber being sucked from the row of nozzle holes; and filling the plurality of pressure-generating chambers with the first liquid under pressure using the liquid supply system and under a condition that the negative pressure chamber is allowed to have a negative pressure lower than an atmospheric pressure by the suction portion.

18. A method of filling a liquid injection head with liquid according to claim 17; wherein the filling under pressure is completed under the condition that the negative pressure chamber is allowed to have a negative pressure lower than an atmospheric pressure by the suction portion.

19. A method of using the liquid injection recording apparatus according to claim 17; further comprising a liquid filling mode in which the suction portion is operated by a first output to render the inside space of the nozzle guard the negative pressure chamber so that liquid overflowing into the negative pressure chamber is sucked from the suction port.

20. A method of using the liquid injection recording apparatus according to claim 17; further comprising switching a liquid filling mode in which the suction portion is operated by a first output to render the inside space of the nozzle guard the negative pressure chamber so that liquid overflowing into the negative pressure chamber is sucked from the suction port, and a normal use mode in which the suction portion is operated by a second output smaller than the first output so that the liquid is injected to the recording medium to perform recording on the recording medium.

21. A liquid injection head comprising:

a nozzle body having a row of nozzle holes;

a nozzle guard that covers the row of nozzle holes, the nozzle guard having a top portion having formed therein a slit opposed to the row of nozzle holes, a sealing portion that seals an area between a peripheral edge of the top portion and the nozzle body, and a suction flow path having a suction port opening below the row of nozzle holes and communicating with a space on an inner side of the nozzle guard; and a suction section connected to the suction flow path of the nozzle guard and causing the space on the inner side of the nozzle guard to form a negative pressure chamber such that a liquid overflowing into the negative pressure chamber is sucked from the suction port of the suction flow path.

22. A liquid injection recording apparatus comprising: a liquid injection head according to claim 21, the liquid injection head further comprising a plurality of pressure-generating chambers each communicating with a respective one of the nozzle holes, and a liquid supply system that supplies the liquid to the plurality of pressure-generating chambers; and a liquid supply portion that supplies the liquid to the liquid supply system of the liquid injection head.

* * * * *

UNITED STATES PATENT AND TRADEMARK OFFICE

CERTIFICATE OF CORRECTION

PATENT NO. : 8,430,477 B2
APPLICATION NO. : 12/736994
DATED : April 30, 2013
INVENTOR(S) : Sakata et al.

It is certified that error appears in the above-identified patent and that said Letters Patent is hereby corrected as shown below:

On the title page item (22), the filing date of the PCT application "May 15, 2009"

should be changed to --May 19, 2009--.

Signed and Sealed this
Twenty-fifth Day of June, 2013

Teresa Stanek Rea
*Acting Director of the United States Patent and Trademark Office*